US010976700B1

(12) United States Patent
Udagawa

(10) Patent No.: US 10,976,700 B1
(45) Date of Patent: Apr. 13, 2021

(54) IMAGE FORMING APPARATUS

(71) Applicant: Oki Data Corporation, Tokyo (JP)

(72) Inventor: Hiroshi Udagawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/998,956

(22) Filed: Aug. 20, 2020

(30) Foreign Application Priority Data

Sep. 19, 2019 (JP) ..... JP2019-170717

(51) Int. Cl.
*G03G 21/16* (2006.01)
*G03G 21/18* (2006.01)

(52) U.S. Cl.
CPC ..... *G03G 21/1842* (2013.01); *G03G 21/1628* (2013.01); *G03G 21/1633* (2013.01); *G03G 21/181* (2013.01); *G03G 21/1857* (2013.01)

(58) Field of Classification Search
CPC ..... G03G 21/1628; G03G 21/1633; G03G 21/1638; G03G 21/181; G03G 21/1842; G03G 21/1857
See application file for complete search history.

(56) References Cited

U.S. PATENT DOCUMENTS

2013/0315619 A1* 11/2013 Shuhama ..... G03G 21/1633 399/110
2019/0302676 A1* 10/2019 Saeki ..... G03G 21/1633

FOREIGN PATENT DOCUMENTS

JP 2011-118201 A 6/2011

* cited by examiner

*Primary Examiner* — Hoang X Ngo
(74) *Attorney, Agent, or Firm* — Muncy, Geissler, Olds & Lowe, P.C.

(57) ABSTRACT

An image forming apparatus includes a main body device; a detachable unit that is attached to the main body device to perform an image formation on a medium, and is detachable with respect to the main body device; an operation part that allows the detachable unit to be detached from the main body device; and a lock part that locks the operation part in a first state at which the detachable unit is not at an image forming state to perform the image formation, and releases the lock of the operation part in a second state at which the detachable unit is at the image forming state.

14 Claims, 21 Drawing Sheets

IMAGE FORMING APPARATUS

TECHNICAL FIELD

This application discloses an image forming apparatus and can be suitably applied to, for example, an electrophotographic image forming apparatus.

BACKGROUND

Conventionally, in an image forming apparatus, insertion and removal of an image forming unit and a toner cartridge are performed by opening a cover of a case to achieve a state in which a user can operate the image forming unit and the toner cartridge or by pulling out a drawable rail unit in which the image forming unit is mounted from the case to expose the image forming unit to the outside of the case.

In such an image forming apparatus, a user operates an operation part and thereby moves a shutter that opens and closes a toner supply port provided in the image forming unit and the toner cartridge to close the toner supply port and then removes the image forming unit. Thereby, toner is prevented from scattering from the image forming unit and the toner cartridge to the outside.

RELATED ART

[Patent Doc. 1] JP Laid-Open Patent Application Publication 2011-11820]

In such an image forming apparatus, it is desirable to improve reliability by preventing an erroneous operation of the operation part.

Embodiments described below are accomplished in consideration of the above problem and is intended to propose an image forming apparatus that can improve reliability.

SUMMARY

An image forming apparatus, disclosed in the application, includes a main body device; a detachable unit that is attached to the main body device to perform an image formation on a medium, and is detachable with respect to the main body device; an operation part that allows the detachable unit to be detached from the main body device; and a lock part that locks the operation part in a first state at which the detachable unit is not at an image forming state to perform the image formation, and releases the lock of the operation part in a second state at which the detachable unit is at the image forming state.

In the case of the non-image forming state, an embodiment(s) of the present invention can prevent an erroneous operation of the operation part by locking the operation part so that the operation part cannot be operated.

According to an embodiment(s) of the present invention, in the case of the non-image forming state, an erroneous operation of the operation part can be prevented by locking the operation part so that the operation part cannot be operated. Thus, an image forming apparatus that can improve reliability can be realized.

BRIEF DESCRIPTION OF THE DRAWINGS

FIG. 15A is a left side view; and FIG. 15B is an enlarged view of a portion of FIG. 15A.

FIG. 16A is a left side view; and FIG. 16B is an enlarged view of a portion of FIG. 16A.

FIG. 17A is a left side view; and FIG. 17B is an enlarged view of a portion of FIG. 17A.

FIG. 18A is a left side view; and FIG. 18B is an enlarged view of a portion of FIG. 18A.

FIG. 21A is a left side view; and FIG. 21B is a front view.

DETAILED DESCRIPTION OF PREFERRED EMBODIMENTS

In the following, modes for carrying out the invention (hereinafter referred to as embodiments) are described using the drawings.

1. Configuration of Image Forming Apparatus

Figure 1:
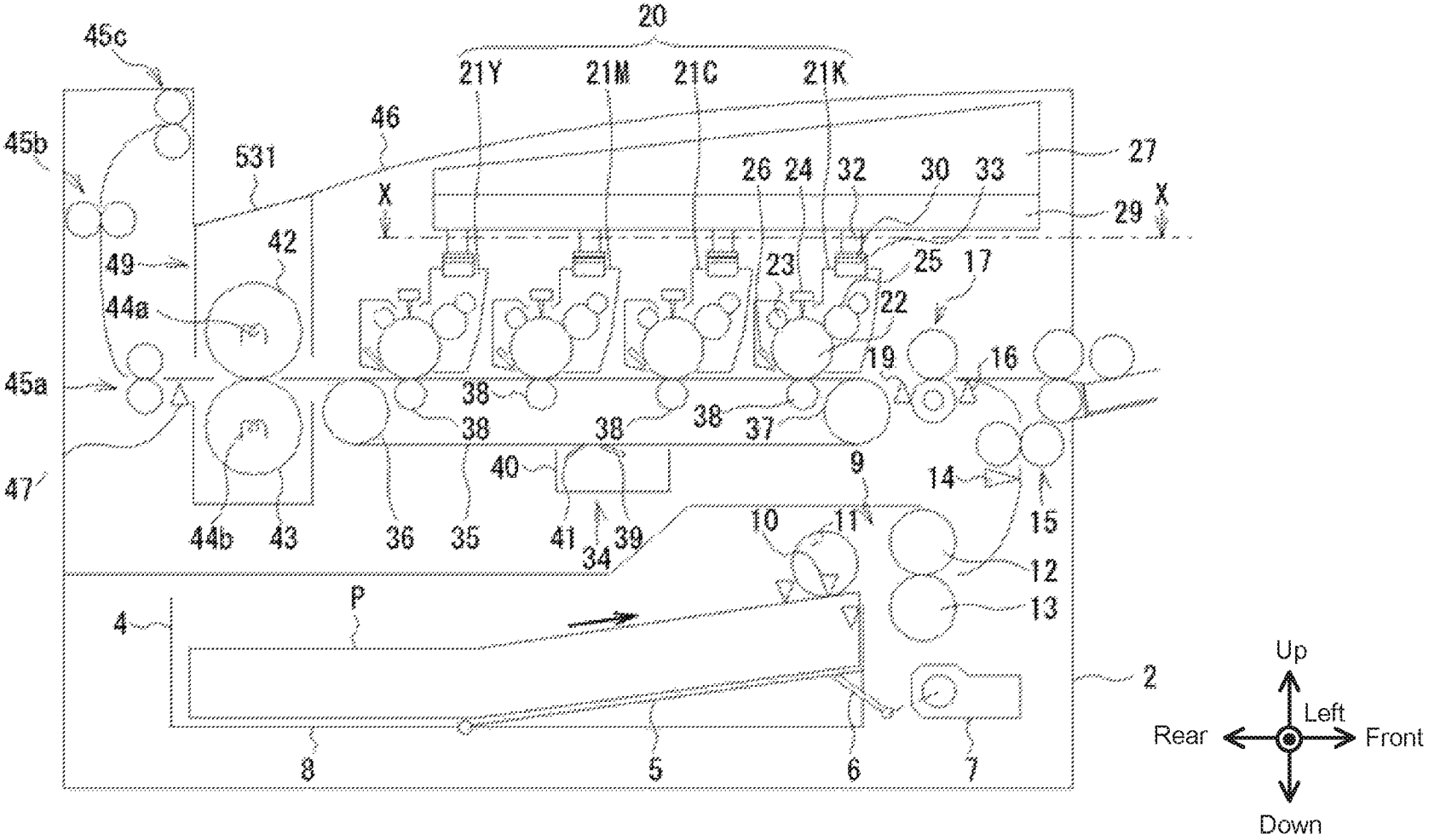
FIG. 1 is a left side view illustrating an overall configuration of an image forming apparatus.
Figure 2:
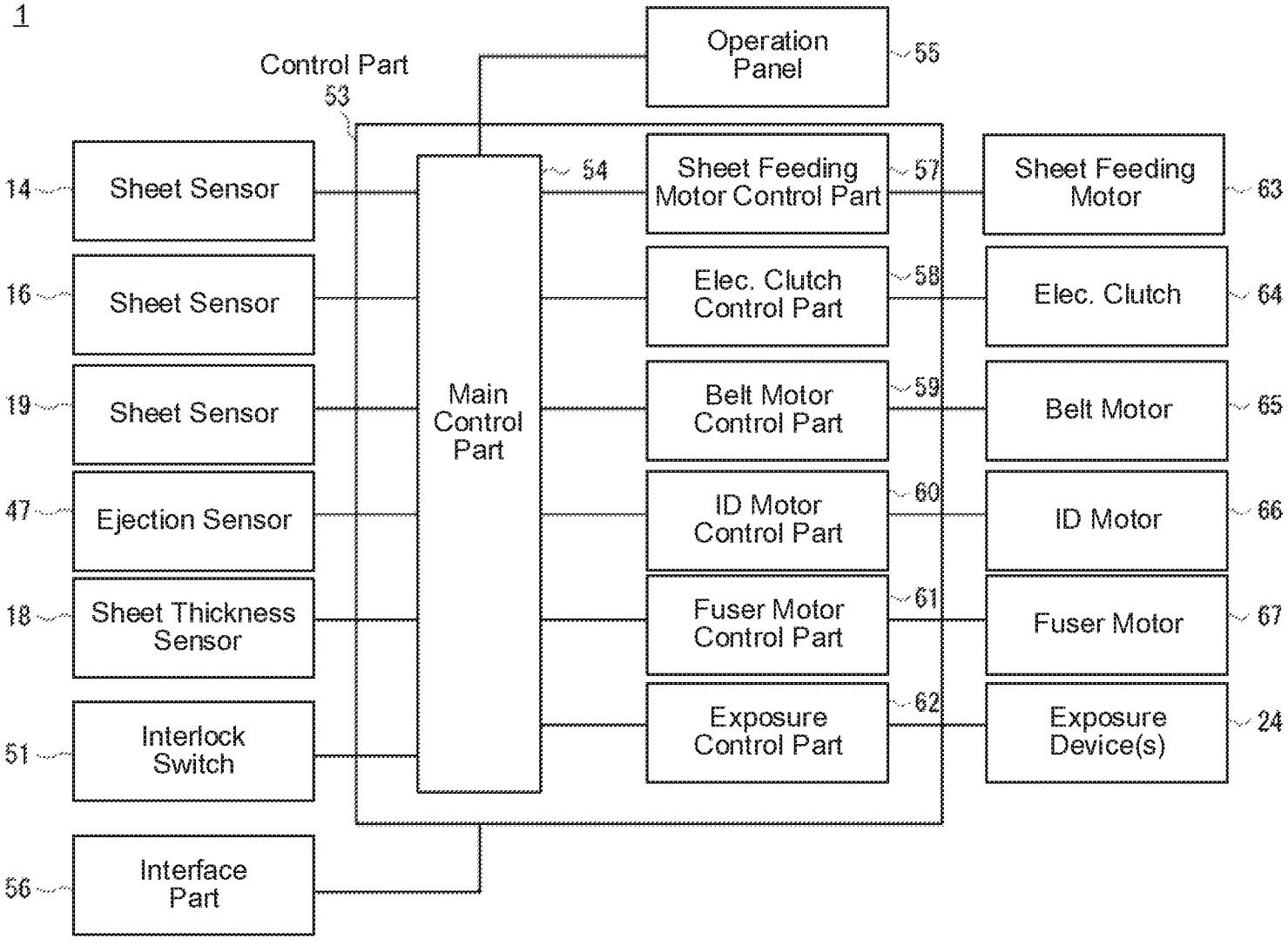
FIG. 2 is a block diagram illustrating a control configuration of the image forming apparatus.

As illustrated in a left side view in FIG. 1, an image forming apparatus 1 is a color electrophotographic printer, and prints a desired color image on a print sheet P of, for example, an A3 size, an A4 size or the like. Various components are arranged inside a substantially box-shaped case 2 of the image forming apparatus 1. A front side case opening part and an upper side case opening part, which allow an interior space surrounded by the case 2 to communicate with the outside, are respectively formed on the front side and the upper side of the case 2, and a front cover 73 (FIG. 4) as a front side opening and closing member that can open and close the front side case opening part and a top cover 48 (FIG. 3) as an upper side opening and closing member that can open and close the upper side case opening part are respectively provided on the front side and the upper side of the case 2. During a print operation, the front cover 73 and the top cover 48 of the case 2 are closed, and thereby, the interior of the image forming apparatus 1 is protected. On the other hand, when a maintenance work is performed by an operator, the front cover 73 and the top cover 48 of the case 2 can be opened as needed, and thereby, operations with respect to the parts inside the case 2 can be easily performed. In the following, description is present by defining the right side in FIG. 1 as the front side of the image forming apparatus 1 and respectively defining an up-down direction, a left-right direction and a front-rear direction as those directions when the image forming apparatus 1 is viewed from the front side. The image forming apparatus 1 is overall controlled by a control part 53 (FIG. 2). The control part 53 is connected to a host device (not illustrated in the drawings) such as a personal computer wirelessly or by wire via a communication processing part (not illustrated in the drawings). When image data representing a color image to be printed is received and printing of the color image is instructed from the host device, the control part 53 executes print processing for forming the print image on a surface of a print sheet P.

A sheet tray 4 is detachably attached to the image forming apparatus 1, and print sheets P are stacked in the sheet tray 4. A sheet-placing plate 5 rotatably supported by a support shaft (not illustrated in the drawings) is provided inside the sheet tray 4, and the print sheets P are stacked on the sheet-placing plate 5. A lift-up lever 6 is rotatably arranged on a support shaft (not illustrated in the drawings) on a feeding-out side of the sheet tray 4, and the support shaft is engaged with a motor 7 in a manner capable of coming into contact with and being separated from the motor. When the sheet tray 4 is inserted into the image forming apparatus 1, the lift-up lever 6 and the motor 7 are engaged with each other, and the control part 53 (FIG. 2) drives the motor 7. When the lift-up lever 6 rotates, a front end part of the lift-up lever 6 lifts the bottom of the sheet-placing plate 5, and the print sheets P stacked on the sheet-placing plate 5 are lifted. When a print sheet P rises to a certain height, the print sheet P becomes in contact with a pickup roller 11. In this case, a rising detection part 10 detects the print sheet P, and transmits a result of the detection to the control part 53 (FIG. 2). Based on the detection result acquired from the rising detection part 10, the control part 53 stops the motor 7. The pickup roller 11, together with a feed roller 12 and a retard roller 13 which are arranged in a pair in a state of being in contact with each other, forms a sheet feeding-out part 9.

The pickup roller 11 and the feed roller 12 are driven by a motor (not illustrated in the drawings) to rotate counterclockwise in FIG. 1, and have a one-way clutch mechanism (not illustrated in the drawings) built therein, and thus, can idle-rotate counterclockwise in FIG. 1 even when the rotational driving has stopped. Further, the retard roller 13 generates a torque counterclockwise in FIG. 1 with a torque generating means (not illustrated in the drawings). Therefore, the pickup roller 11 pulls out from the sheet tray 4 a print sheet P that is in contact with the pickup roller 11. For example, even when multiple print sheets P are pulled out at the same time, the feed roller 12 and the retard roller 13 sequentially feed out the print sheets P one by one to a carrying path.

On a downstream side of the sheet feeding-out part 9 in a carrying direction of a print sheet P, a sheet sensor 14, a carrying roller pair 15, a sheet sensor 16, a carrying roller pair 17 and a sheet sensor 19 are arranged in this order from an upstream side to a downstream side in the carrying direction. The carrying roller pair 15 regulates a skew of the print sheet P. The sheet sensor 16 detects a drive timing of the carrying roller pair 17 positioned on a downstream side in the carrying direction. The carrying roller pair 17 feeds the print sheet P to an image forming part 20. The sheet sensor 19 takes a write timing in the image forming part 20. Power is transmitted to the carrying roller pairs 15 and 17 from a carrying drive motor (not illustrated in the drawings) via a drive transmitting means (not illustrated in the drawings).

Above the sheet tray 4 in the case 2, a transfer belt unit 34 is provided extending in the front-rear direction across a large portion of the interior of the case 2. In the transfer belt unit 34, a tension roller 37 and a drive roller 36 each having a thin and long cylindrical shape with a central axis oriented in the left-right direction are respectively arranged on the front and rear sides, and a transfer belt 35 is stretched around the tension roller 37 and the drive roller 36 on the front and rear sides. The transfer belt 35 is formed as an endless belt having a wide width in the left-right direction, and moves along with the rotation of the drive roller 36. In the transfer belt unit 34, based on the control of the control part 53 (FIG. 2), the drive roller 36 is caused to rotate, and thereby, the transfer belt 35 is caused to move, and a print sheet P received from the sheet feeding-out part 9 is placed on an upper surface of the transfer belt 35 and is carried rearward.

On the other hand, above the transfer belt unit 34, that is, on an upper side of a center of the case 2, the image forming part 20 is provided in which four process units 21K, 21C, 21M and 21Y (hereinafter, these are also collectively referred to as the process units 21) are arranged in order from the front side toward the rear side. That is, the process units 21 of respective colors are arranged in a so-called tandem system. The process units 21K, 21C, 21M and 21Y as development units respectively correspond to colors of black (K), cyan (C), magenta (M) and yellow (Y). Further, the process units 21K, 21C, 21M and 21Y are configured in the same way as each other, and only the corresponding colors are different. The process units 21 are detachably attached to a basket 90 (FIG. 7) in the up-down direction orthogonal to the carrying direction in the carrying path of the print sheet P. Considering the detachable feature of the process units, the process units may be referred as detachable units.

A toner container 27 is provided in a top frame 86 above the image forming part 20. In the toner container 27, multiple toner cartridges 28 (FIG. 21B) that store toners and supply the toners to development rollers 25 (to be described later) are detachably attached to the image forming apparatus 1. Toners are supplied from the toner cartridges 28K, 28C, 28M and 28Y (FIG. 21B) of the respective colors of black, cyan, magenta and yellow attached to the toner container 27 to a toner carrying part 29, and are supplied from the toner carrying part 29 via ducts 32 to the process units 21K, 21C, 21M and 21Y. Power is transmitted from a drive source (not illustrated in the drawings) via gears (not illustrated in the drawings) to drums or rollers used in the image forming apparatus 1, and the drums or rollers rotate.

Next, an internal configuration of the process unit 21K is described. For example, in the process unit 21K, a photosensitive drum 22 is arranged so as to be rotatable clockwise, and a charging roller 23, an exposure device 24, a development roller 25 and a cleaning blade 26 are arranged in this order from an upstream side to a downstream side in the rotation direction around the photosensitive drum 22. The charging roller 23 charges a surface of the photosensitive drum 22 by supplying electric charges to the surface. The exposure device 24 selectively irradiates the charged surface of the photosensitive drum 22 with light to form an electrostatic latent image. The development roller 25 performs development by attaching toner to the surface of the photosensitive drum 22 on which the electrostatic latent image is formed. The cleaning blade 26 removes transfer residual toner remaining on the photosensitive drum 22 without being transferred.

Transfer rollers 38 each formed of a conductive rubber or the like are respectively arranged in a state of being pressed via the transfer belt 35 against the photosensitive drums 22 of the process units 21K-21C. Potentials are respectively applied to the transfer rollers 38 for achieving potential differences between surface potentials of the photosensitive drums 22 and surface potentials of the transfer rollers 38 when toner images due to toners adhered on the photosensitive drums 22 are transferred to a print sheet P.

The transfer belt 35 electrostatically adsorbs and carries the print sheet P. The drive roller 36 drives the transfer belt 35 together with the tension roller 37 which forms a pair with the drive roller 36 to stretch the transfer belt 35. Power is transmitted to the drive roller 36 from a drive source (not illustrated in the drawings) via a drive transmitting means (not illustrated in the drawings), and the drive roller 36 is rotationally driven. The cleaning blade 39 performs cleaning by scraping off toner adhering to the transfer belt 35. A toner box 40 contains the scraped-off toner. On an upstream side of the cleaning blade 39 in a carrying direction of the transfer belt 35, a film 41 is provided in contact with the transfer belt 35 to prevent the toner scraped off by the cleaning blade 39 from scattering to outside of the toner box 40.

The fuser 49 is formed of a roller pair including an upper roller 42 and a lower roller 43. A halogen lamp 44*a* as a heat source is provided inside the upper roller 42 and a surface of the upper roller 42 is formed of an elastic material. Similarly, a halogen lamp 44*b* as a heat source is provided inside the lower roller 43 and a surface of the lower roller 43 is formed of an elastic material. The fuser 49 applies heat and pressure to a toner image on a print sheet P carried from the image forming part 20 to melt the toner image and fuse the toner image onto the print sheet P. After that, the print sheet P is carried by ejection roller pairs 45*a*, 45*b* and 45*c*, and is eventually ejected to a stacker part 46. Power is transmitted to the ejection roller pairs 45*a*, 45*b* and 45*c* from a drive source (not illustrated in the drawings) via a drive transmitting means (not illustrated in the drawings). An ejection sensor 47 arranged in an output part of the fuser 49 detects a drive timing of the ejection roller pairs 45*a*, 45*b* and 45*c*.

2. Control Configuration of the Image Forming Apparatus

As illustrated in FIG. 2, the image forming apparatus 1 is overall controlled by the control part 53. The control part 53 has a main control part 54 as a control center. The main control part 54 has therein a CPU (Central Processing Unit) formed of a control part and an arithmetic part, a RAM (Random Access Memory) as a program memory, a ROM (Read Only Memory), and the like. The main control part 54 performs activation and control switching of the parts and devices based on detection signals input from the sheet sensor 14, the sheet sensor 16, the sheet sensor 19, the ejection sensor 47, a sheet thickness sensor 18 and an interlock switch 51. A sheet feeding motor control part 57, an electromagnetic clutch control part 58 (or Elec. Clutch Control Part in the Fig.), a belt motor control part 59, an ID motor control part 60, a fuser motor control part 61 and an exposure control part 62 are connected to the main control part 54.

The sheet feeding motor control part 57 controls a sheet feeding motor 63 by transmitting an operation signal to the sheet feeding motor 63. The electromagnetic clutch control part 58 controls operation of an electromagnetic clutch 64 (or Elec. Clutch in the Fig.) by transmitting an operation signal to the electromagnetic clutch 64. The belt motor control part 59 controls operation of a belt motor 65 by transmitting an operation signal to the belt motor 65. The ID motor control part 60 controls operation of an ID motor 66 by transmitting an operation signal to the ID motor 66. The fuser motor control part 61 controls operation of a fuser motor 67 by transmitting an operation signal to the fuser motor 67.

Further, the image forming apparatus 1 has an operation panel 55. The operation panel 55 includes an input part formed of a switch (not illustrated in the drawings), and a display part formed of an LED (Light Emitting Diode), an LCD (Liquid Crystal Display) or the like. In the operation panel 55, by operating the input part (not illustrated in the drawings), various conditions in the image forming apparatus 1 such as font selection and sheet selection are set. Further, in the display part (not illustrated in the drawings), the conditions set by the input part (not illustrated in the drawings) are displayed.

Further, the image forming apparatus 1 has an interface part 56. The interface part 56 is formed of an illustrate connector, an illustrate IC, and the like (which are not illustrated in the drawings), and forwards print data transmitted from a host computer (not illustrated in the drawings) to the main control part 54. Further, the exposure control part 62 performs optical writing control of the exposure devices 24 for forming an electrostatic latent image in the image forming part 20 with respect to the print data forwarded to the main control part 54. The interlock switch 51 is provided on the front side of the case 2 (FIG. 4), and detects an opening and closing state of the front cover 73.

3. Configurations of Covers

Figure 3:
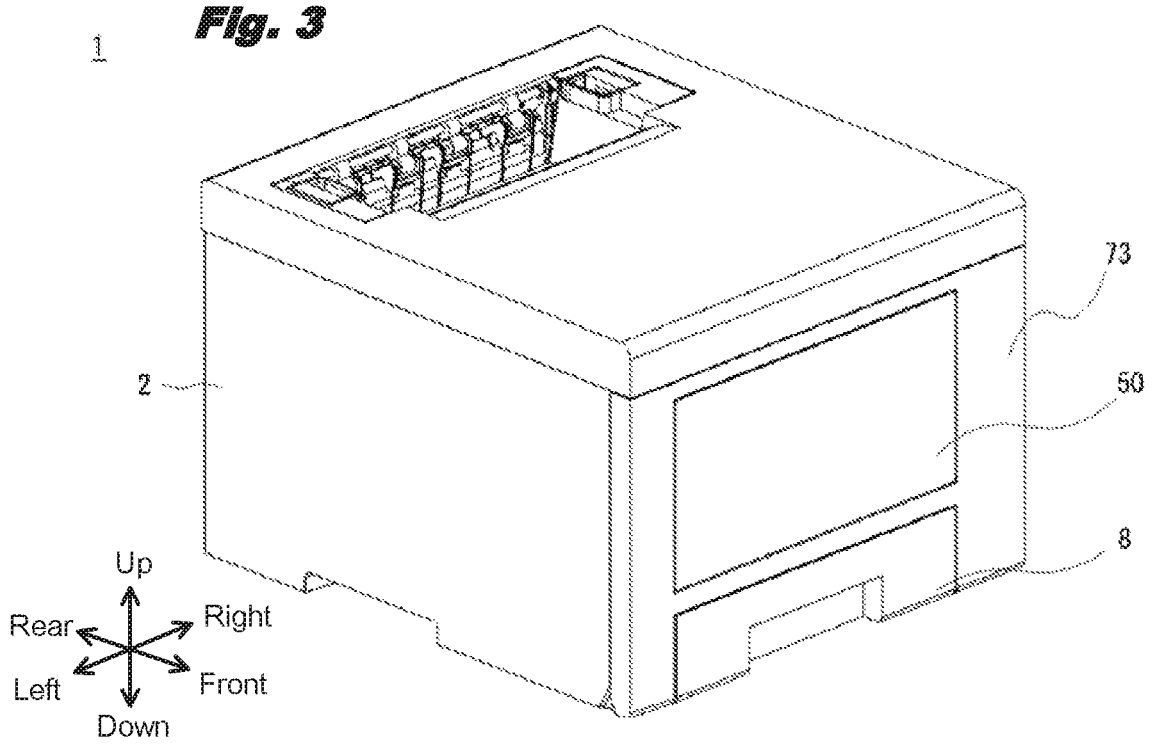
FIG. 3 is a perspective view illustrating external configuration of the image forming apparatus in a cover closed state.
Figure 21A:
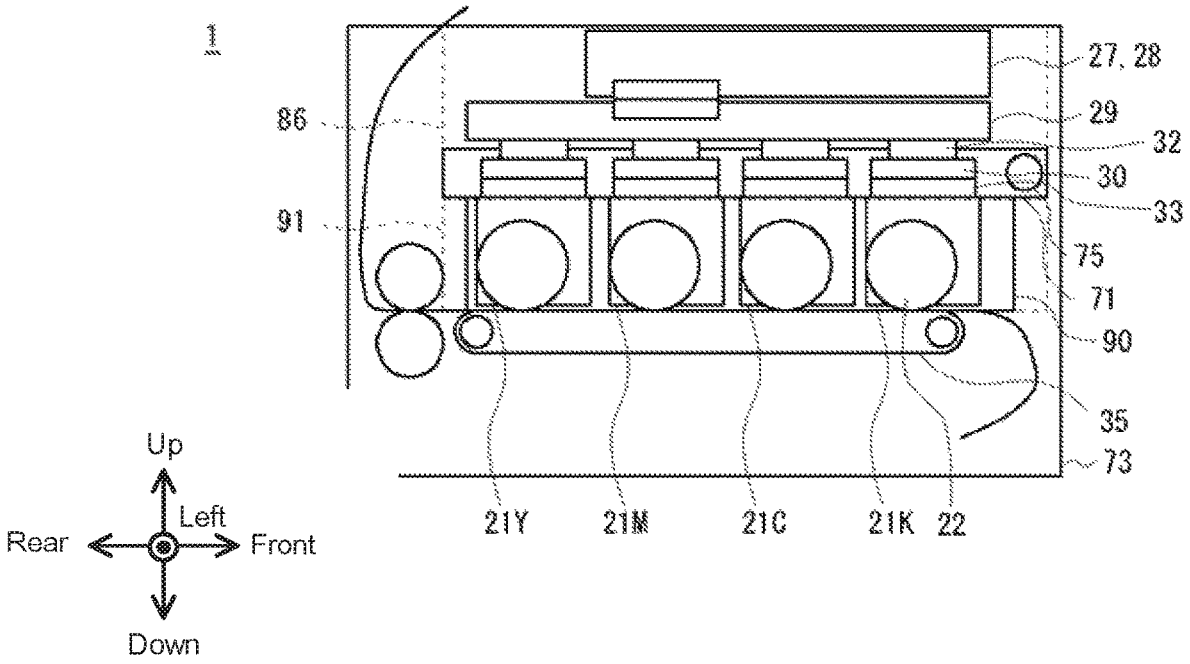
FIGS. 21A and 21B illustrate a simplified configuration of the image forming apparatus in a cover closed state.
Figure 21B:
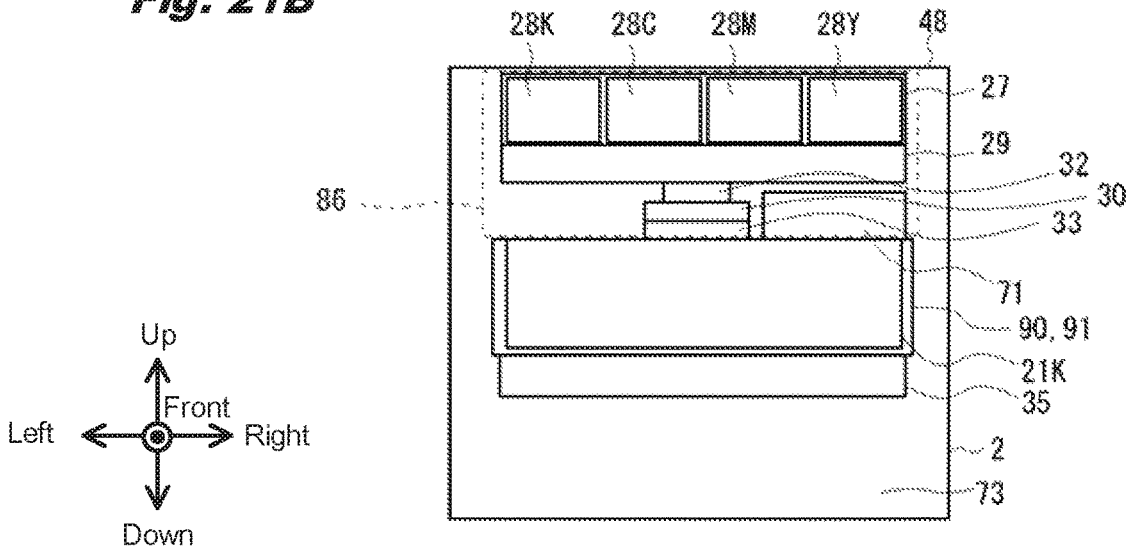

As illustrated in FIG. 3, in the image forming apparatus 1, the front cover 73, a tray cover 8 and an MPT cover 50 are provided on the front side of the apparatus, and the top cover 48 is provided on the upper side of the apparatus. The front cover 73, the MPT cover 50 and the top cover 48 are external covering members that can be opened and closed by a user. The tray cover 8 is an external covering member of the sheet tray 4 that can be inserted and removed by a user. FIGS. 3, 21A and 21B illustrate a cover closed state in which the front cover 73, the MPT cover 50, the top cover 48 and the tray cover 8 are all closed. In the cover closed state, the image forming apparatus 1 is in an image forming state which is a state in which the photosensitive drums 22 of the process units 21 are in contact with the transfer belt 35 and an image can be formed on the print sheet P. The process units 21 in the image forming state are each positioned at an image forming position which is a position at which an image can be formed on the print sheet P.

3-1. Configuration of Front Cover

Figure 4:
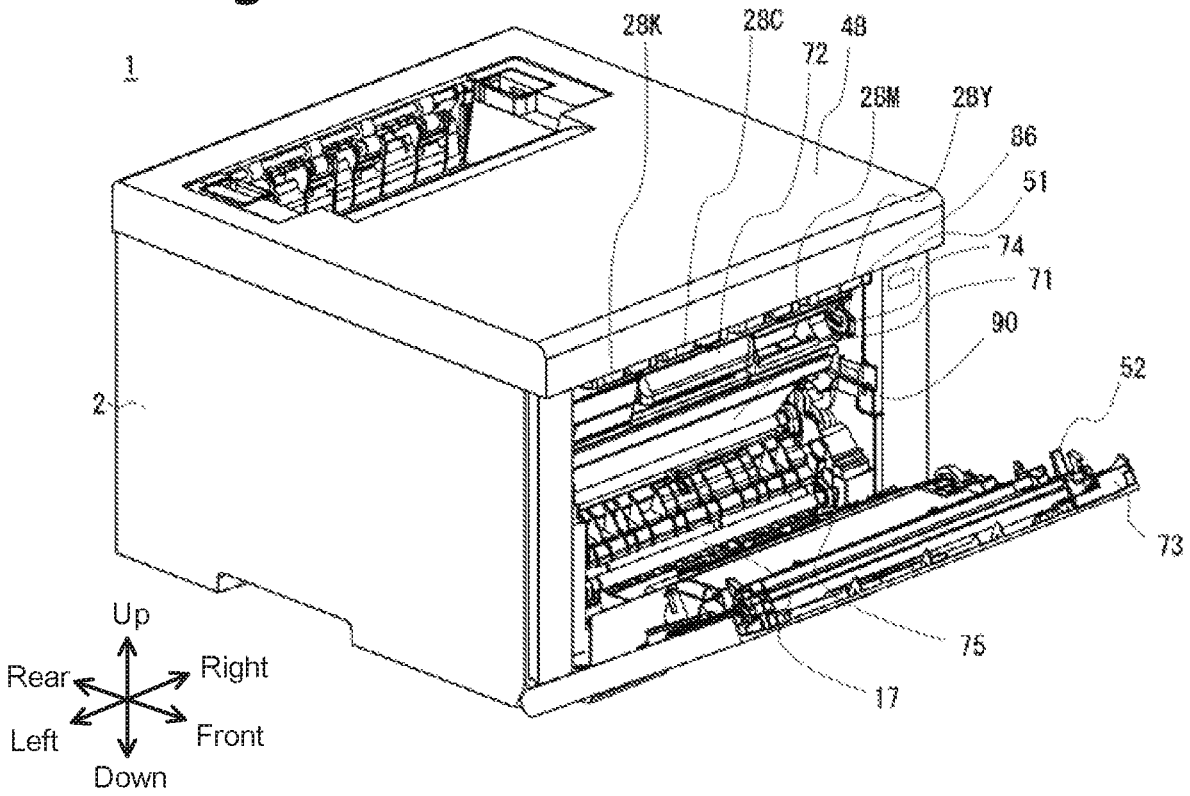
FIG. 4 is a perspective view illustrating an external configuration of the image forming apparatus in a front cover opened state.
Figure 5:
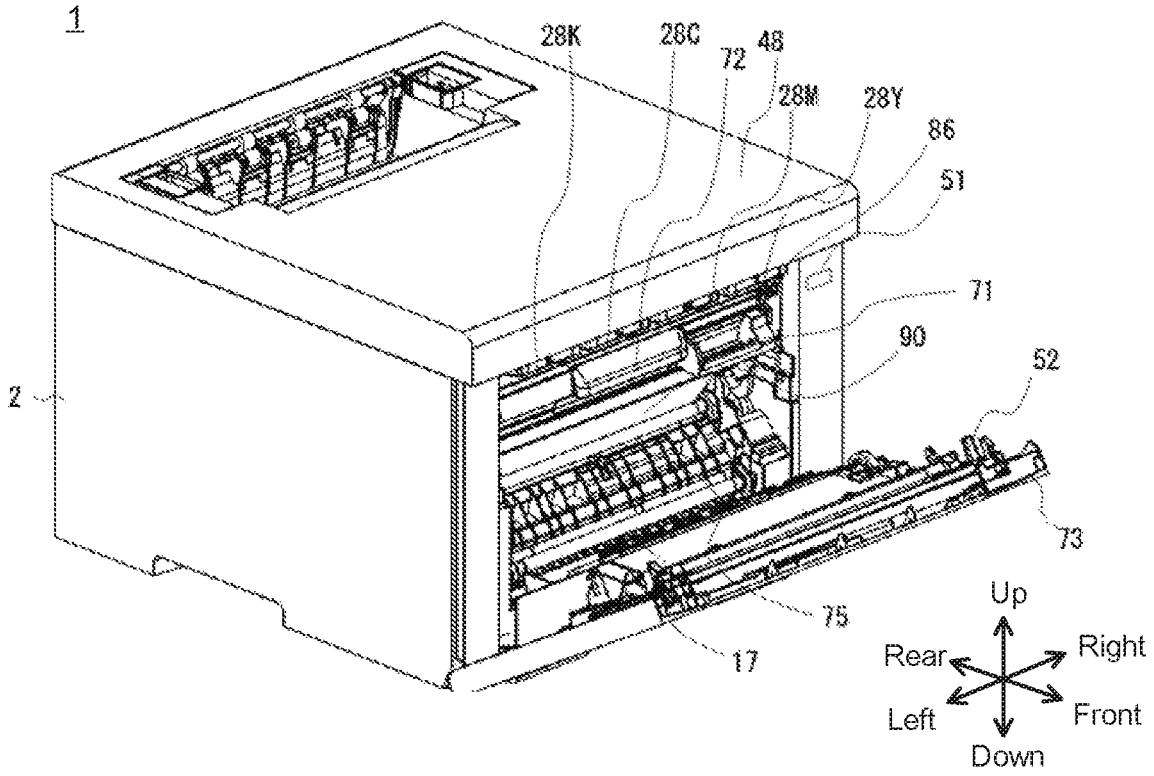
FIG. 5 is a perspective view illustrating an external configuration of the image forming apparatus in a shutter handle pulled out state.

The front cover 73 is provided rotatable with a rotation shaft provided at a lower end part thereof as a supporting point such that an upper end part thereof moves in the front-rear direction with respect to the case 2. In a front cover opened state illustrated in FIG. 4 in which the front end part of the front cover 73 is pulled forward and a front side case opening is exposed to the outside, the toner cartridges 28K, 28C, 28M and 28Y are exposed to the outside of the image forming apparatus 1, and can be inserted and removed by a user. Further, in the front cover opened state, as illustrated in FIG. 4, the carrying roller pairs 15 and 17 are exposed to the outside of the image forming apparatus 1, by appropriately lifting the top cover 48, a jammed sheet which is a print sheet P jammed inside the image forming apparatus 1 can be removed by a user. Further, in the front cover opened state, a shutter handle 71 of a shutter link part 70 (FIG. 9) for opening and closing shutters 33 (FIGS. 6 21A and 21B) respectively provided in the process units 21K, 21C, 21M and 21Y and a handle 72 for opening and closing the top cover 48 are provided at positions exposed on the front side of the apparatus to allow a user to operate them. The shutter handle 71 is arranged so that it can be moved horizontally.

Further, the interlock switch 51 detecting an opening and closing state of the front cover 73 is provided on the front side of the case 2 (FIG. 4). In the front cover closed state (FIG. 3), when a front cover pressing protrusion 52 provided on the front cover 73 is pressed, the interlock switch 51 detects an ON state and transmits the detection result to the control part 53 (FIG. 2). On the other hand, in the front cover opened state (FIG. 4), when the front cover pressing protrusion 52 is not pressed, the interlock switch 51 detects an OFF state, and transmits the detection result to the control part 53 (FIG. 2). Based on the detection result acquired from the interlock switch 51, the control part 53 detect that the front cover is closed in the case of the ON state, and detects that the front cover is opened in the case of the OFF state.

Further, in the top cover closed state (FIG. 3), when a top cover pressing protrusion 99 provided on the top cover 48 is pressed, the interlock switch 51 detects an ON state, and transmits the detection result to the control part 53 (FIG. 2). On the other hand, in the top cover opened state (FIG. 6), when the top cover pressing protrusion 99 is not pressed, the interlock switch 51 detects an OFF state, and transmits the detection result to the control part 53 (FIG. 2). Based on the detection result acquired from the interlock switch 51, the control part 53 detect that the top cover is closed in the case of the ON state, and detects that the top cover is opened in the case of the OFF state.

3-2. Configuration of MPT Cover

The MPT cover 50 is provided rotatable with a rotation shaft provided at a lower end part thereof as a supporting point such that an upper end part thereof moves in the front-rear direction with respect to the case 2. In an opened state in which the upper end part of the MPT cover 50 is pulled forward, a print sheet P is placed on an upper side of the MPT cover 50.

3-3. Configuration of Top Cover

Figure 16A:
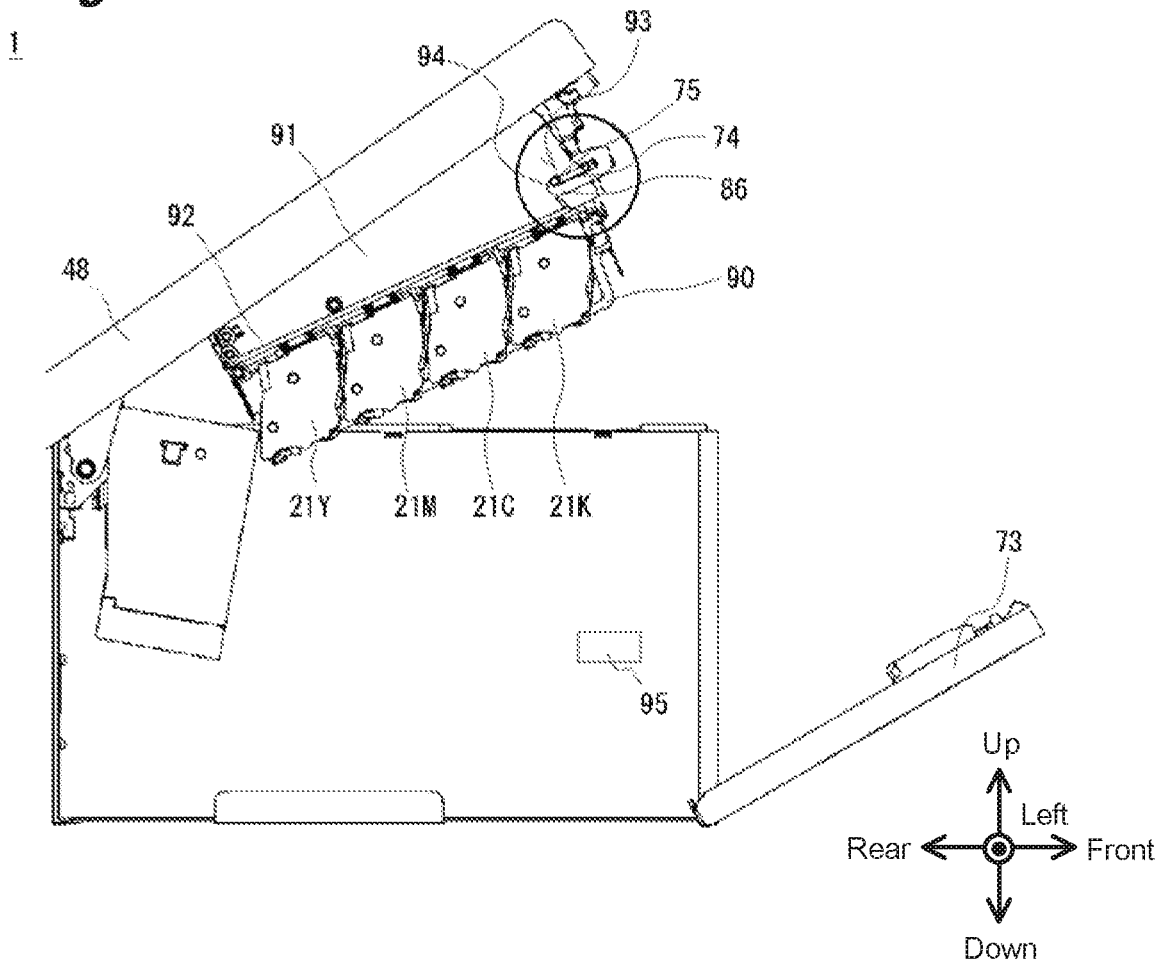
FIGS. 16A and 16B illustrate the configuration of the image forming apparatus in a locking part locked state.
Figure 16B:
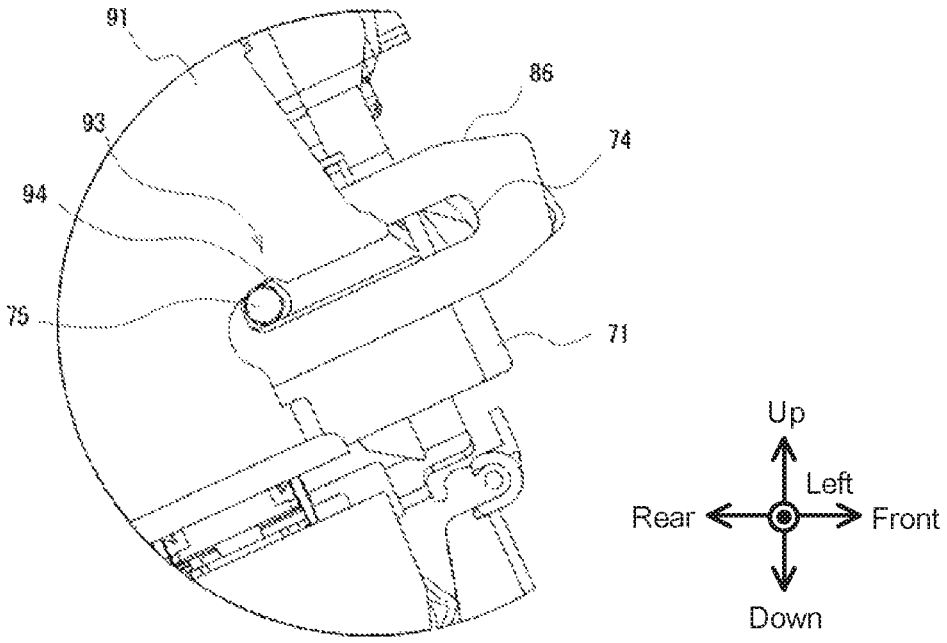

The top cover 48 is provided rotatable with a rotation shaft provided at a rear end part thereof as a supporting point such that a front end part thereof moves in the up-down direction with respect to the case 2. In the front cover opened state (FIG. 4), without pulling the shutter handle 71 forward, when a user pulls the handle 72 forward and then lifts the front end part of the top cover 48 upward, the top cover opened state illustrated in FIGS. 8, 16A, 16B, and 26 is achieved. When the top cover opened state is achieved without pulling the shutter handle 71 forward, in addition to the toner container 27, the toner carrying part 29, the ducts 32, duct shutters 30 and the shutter handle 71 illustrated in FIG. 26 accommodated in the top frame 86 (FIG. 8) fixed to the top cover 48, the basket 90 in which the process units 21 are accommodated is lifted together with the top cover 48, and, as illustrated in FIGS. 16A and 16B, a basket externally lifted state is achieved in which the basket 90 rises above an upper surface of the case 2. In the basket externally lifted state, the image forming apparatus 1 is in a non-image forming state which is a state in which the photosensitive drums 22 of the process units 21 are separated upward from the transfer belt 35, and an image is not formed on the print sheet P. The process units 21 in the non-image forming state are each positioned at a non-image forming position which is a position at which an image cannot be formed on the print sheet P. Therefore, in the basket externally lifted state, in the image forming apparatus 1, spacing between the process units 21 and the transfer belt 35 in the up-down direction is increased, and thereby, a jammed sheet which is a print sheet P jammed between the process units 21 and the transfer belt 35 can be easily removed by a user.

Figure 15A:
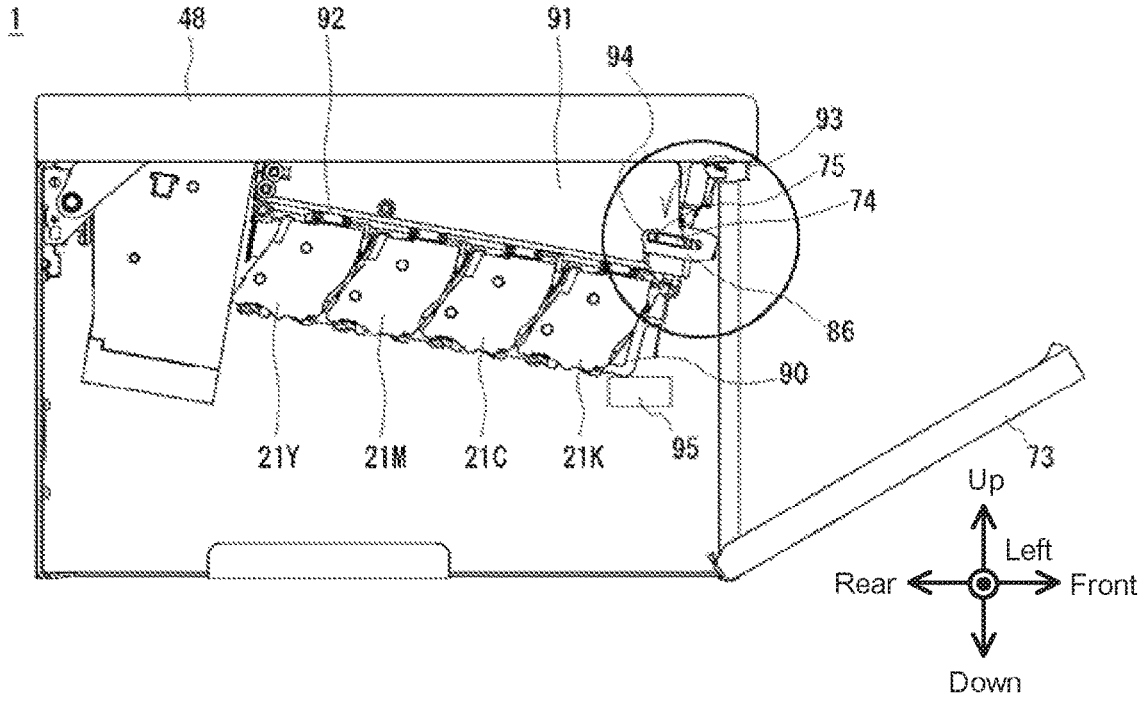
FIGS. 15A and 15B illustrate the configuration of the image forming apparatus in a locking part non-locked state.
Figure 18A:
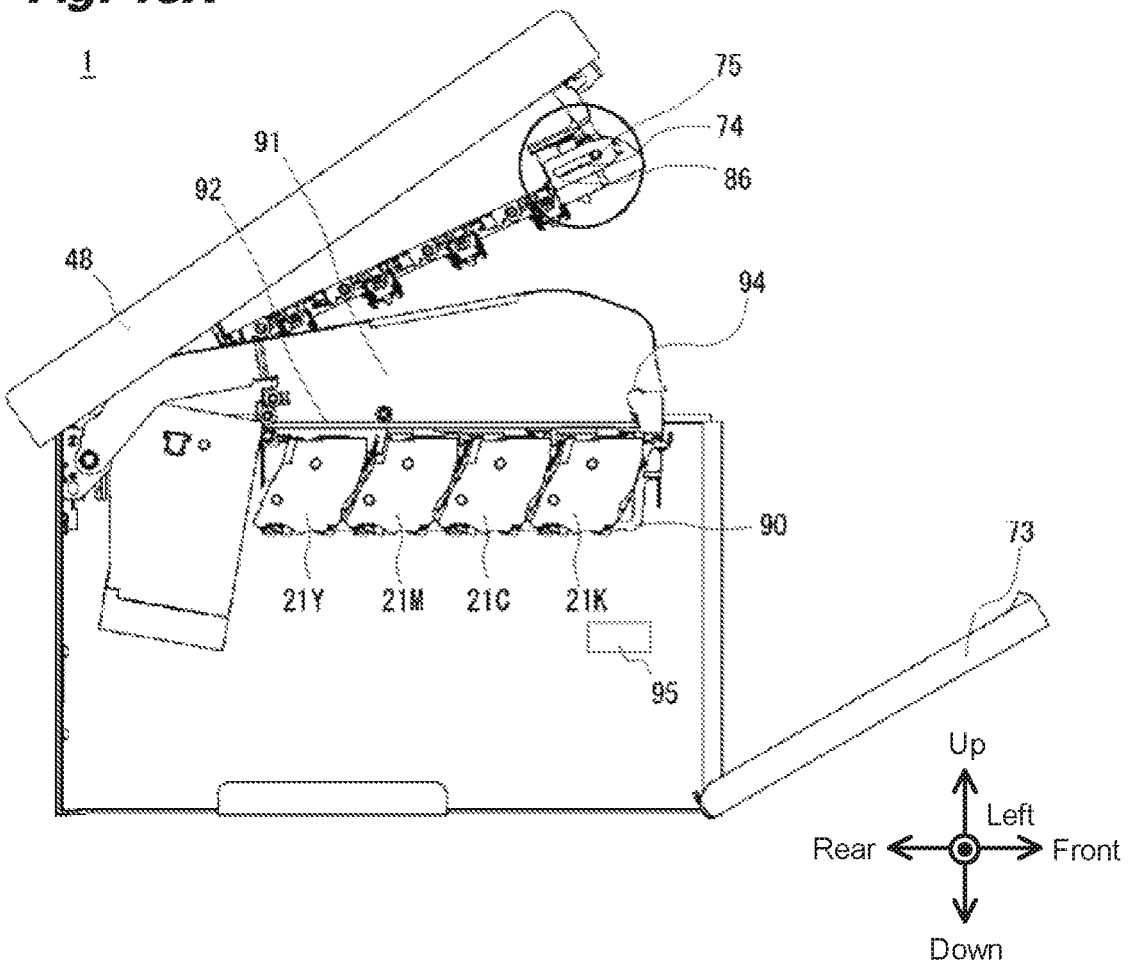
FIGS. 18A and 18B illustrate the configuration of the image forming apparatus in a locking part released state and a basket internally lifted state.
Figure 18B:
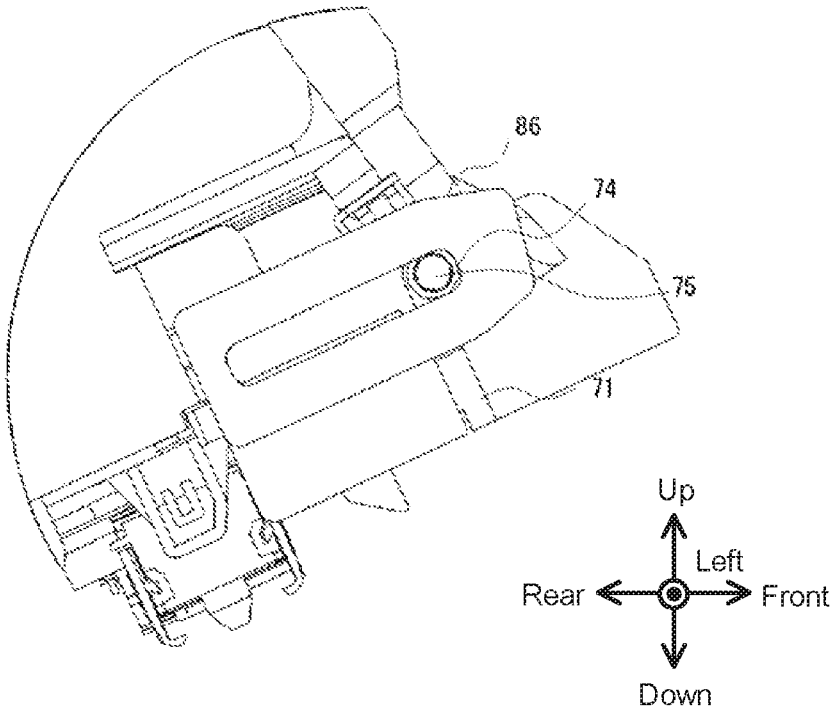

On the other hand, in the front cover opened state (FIG. 4), when a user pulls out the shutter handle 71 forward (FIGS. 5, 16A, 16B and 23), and then, pulls the handle 72 forward and then lifts the front end part of the top cover 48 upward, the top cover opened state illustrated in FIGS. 6, 18A, 18B and 24 is achieved. When the shutter handle 71 is pulled out forward and then the top cover opened state is achieved, since the top frame 86 and a basket frame 91 are disengaged, the toner container 27, the toner carrying part 29, the ducts 32, the duct shutters 30 and the shutter handle 71, which are accommodated in the top frame 86, are lifted together with the top cover 48. In this case, although the basket 90 in which the process units 21 are accommodated has transitioned from a basket accommodated state which is a state in which the process units 21 are arranged in a forwardly descending direction as illustrated in FIG. 15A and which is an image forming state to a state in which the basket 90 is slightly lifted together with the top cover 48 and the process units 21 are arranged in a horizontal direction as illustrated in FIGS. 18A and 18B, the image forming apparatus 1 is in a basket internally lifted state in which the basket 90 is still accommodated inside the case 2. In the basket internally lifted state, the image forming apparatus 1 is in the non-image forming state. In the basket internally lifted state, when a user pulls out forward the basket 90, the image forming apparatus 1 transitions to a basket pulled-out state illustrated in FIGS. 8 and 25. In the basket pulled-out state, the process units 21 are exposed to the outside of the image forming apparatus 1, and the process units 21 are in a state of being detachable by a user.

Further, the top cover 48 is biased by a biasing member (not illustrated in the drawings) to rotate in a top cover opening direction from the top cover closed state to the top cover opened state. Therefore, when the top cover 48 is lifted to some extent by a user from the top cover closed state in the top cover opening direction, due to a biasing force of the biasing member, the top cover 48 is rotated in the top cover opening direction until the top cover 48 becomes in contact with a predetermined stopper, and the image forming apparatus 1 is in the top cover opened state.

4. Configuration of Shutter Link Part

Figure 9:
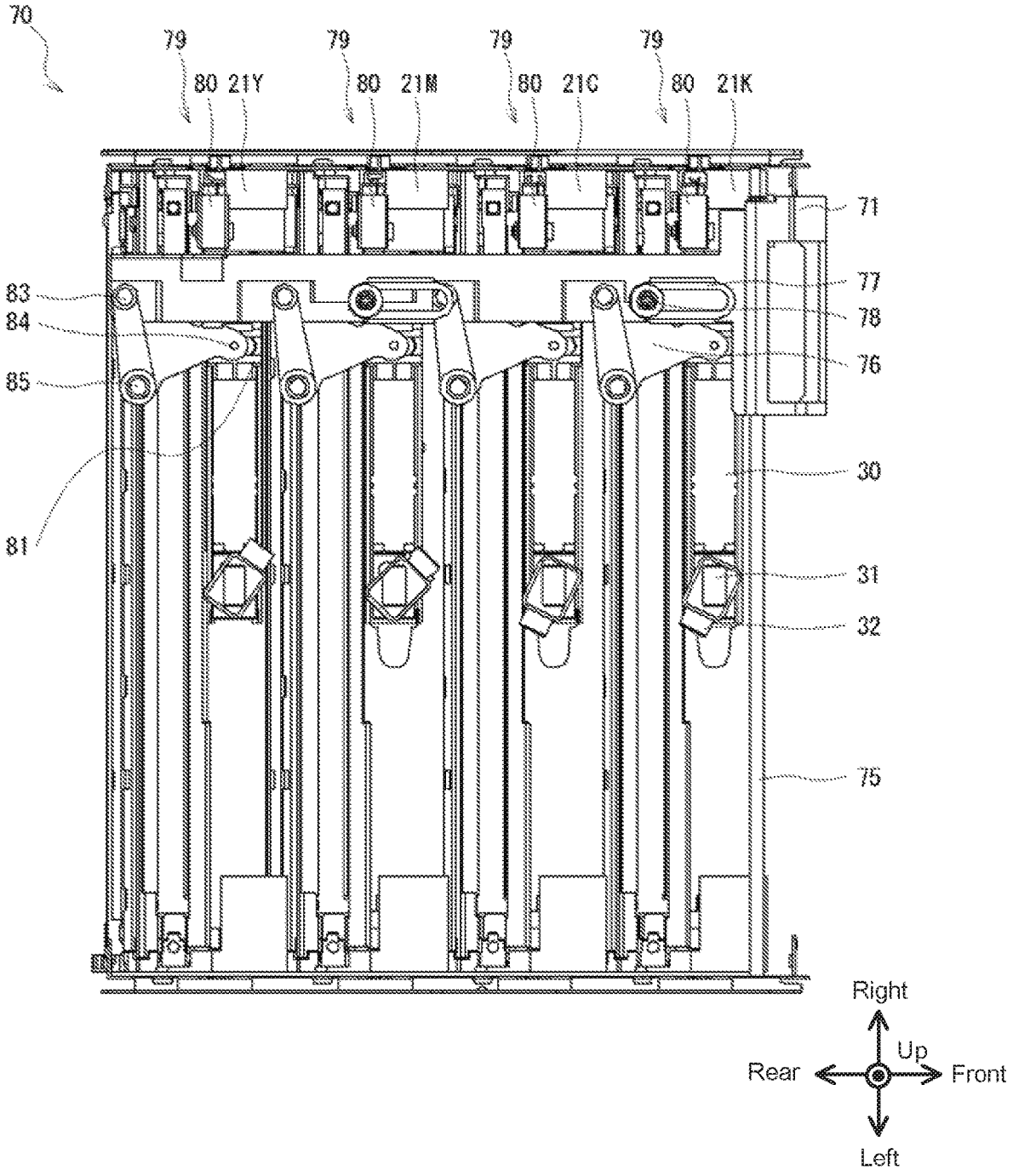
FIG. 9 illustrates a configuration of a shutter link part in a shutter handle pushed-in state as viewed from an X-X arrow in FIG. 1.
Figure 10:
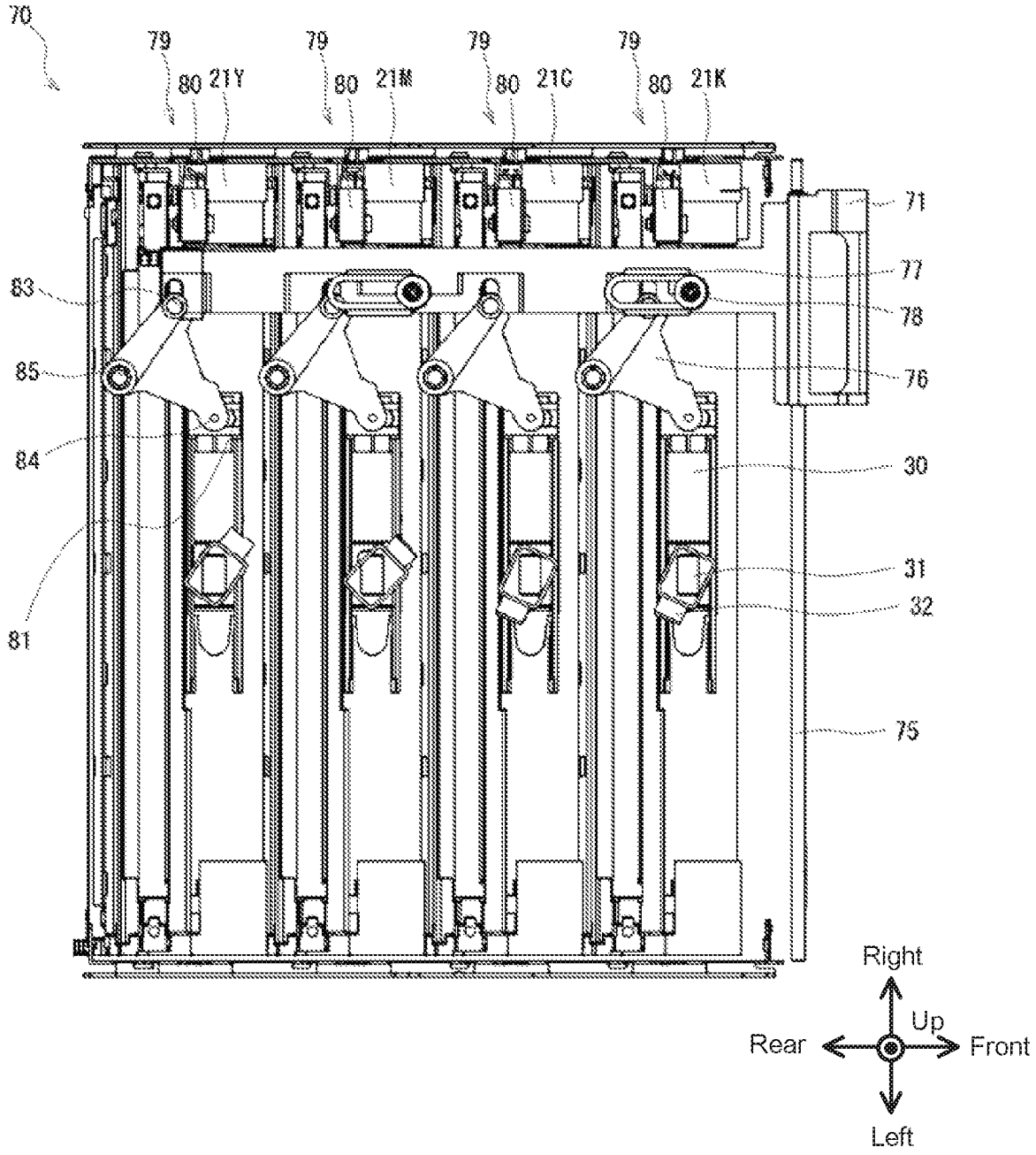
FIG. 10 illustrates a configuration of the shutter link part in a shutter handle pulled-out state as viewed from the X-X arrow in FIG. 1.

As illustrated in FIGS. 9 and 10, the shutter link part 70 is provided above the process units 21, and the shutter handle 71, sliders 77, washers 78, link engaging shafts 83, lever rotation shafts 85, link levers 76, fitting parts 81, shafts 75 and the duct shutters 30 are provided. The shutter handle 71 is provided on the top frame 86 (FIG. 4), and is arranged movable by being guided by the sliders 77 with the washers 78 sliding in the sliders 77.

FIG. 10 illustrates a shutter handle pulled-out state in which the shutter handle 71 has been pulled out forward. In the shutter handle pulled-out state, by achieving a locking part released state (to be described later), the top frame 86 and the basket frame 91 are disengaged, the basket frame 91 and the top frame 86 can be physically separated from each other, and the top frame 86 can be lifted upward (FIG. 6), and, by achieving a shutter closed state (to be described later), a blocked state is achieved in which the duct shutters 30 as shutter members block the toner supply ports 31, and toners of the toner carrying part 29 cannot be supplied to the process units 21. Further, in the shutter handle pulled-out state illustrated in FIGS. 17A, 17B, and 20, closing the front cover 73 in an opened state is physically interfered by the shutter handle 71, and the front cover 73 cannot be rotated to the front cover closed state. On the other hand, when the shutter handle 71 is pushed to a deep side to achieve a shutter handle pushed-in state, the front cover 73 no longer physically interferes with the shutter handle 71, and the front cover 73 can be rotated to the front cover closed state.

On the other hand, FIG. 9 illustrates the shutter handle pushed-in state which is a state in which the shutter handle 71 is pushed in to a deep side of the apparatus. In the shutter handle pushed-in state, when the top cover 48 is lifted, by achieving a locking part locked state (to be described later), the top frame 86 and the basket frame 91 are engaged with each other, and the basket frame 91 can be lifted upward together with the top frame 86 (FIG. 8) in a state in which the basket frame 91 and the top frame 86 are physically integrated, and, by achieving a shutter opened state (to be described later), the duct shutters 30 open the toner supply ports 31, and a state is achieved in which toners of the toner carrying part 29 can be supplied to the process units 21.

Further, the shutter handle 71 is arranged so as to be connected to and interlocked with the process units 21K, 21C, 21M and 21Y via the four link levers 76. The link levers 76 are engaged with the shutter handle 71 via the link engaging shafts 83, and are further respectively engaged with the fitting parts 81 via shutter operation shafts 84. The link levers 76 are respectively arranged to be rotatable about the lever rotation shafts 85. The fitting parts 81 are respectively provided in the duct shutters 30. The duct shutters 30 are respectively provided so as to be movable by the shutter operation shafts 84 in a direction parallel to the left-right direction which is a direction perpendicular to the front-rear direction which is a movement direction of the shutter handle 71. The duct shutters 30 are respectively arranged so as to be able to open and close the toner supply ports 31 provided in the ducts 32 provided in the top frame 86.

Further, the process units 21K, 21C, 21M and 21Y are held in the basket 90 (FIG. 6) provided inside the image forming apparatus 1. The basket 90 is provided so as to be movable in a direction parallel to the front-rear direction by a rail part 92 (FIGS. 18A and 18B) provided on the basket frame 91 which is formed of sheet metals extending on the left and right sides of the basket 90 in the front-rear and up-down directions. The rail part 92 holds the basket 90 movable to a position at which the process units 21K, 21C, 21M and 21Y are exposed to the outside of the image forming apparatus 1.

5. Configuration of Discharge Lock Mechanisms

Figure 6:
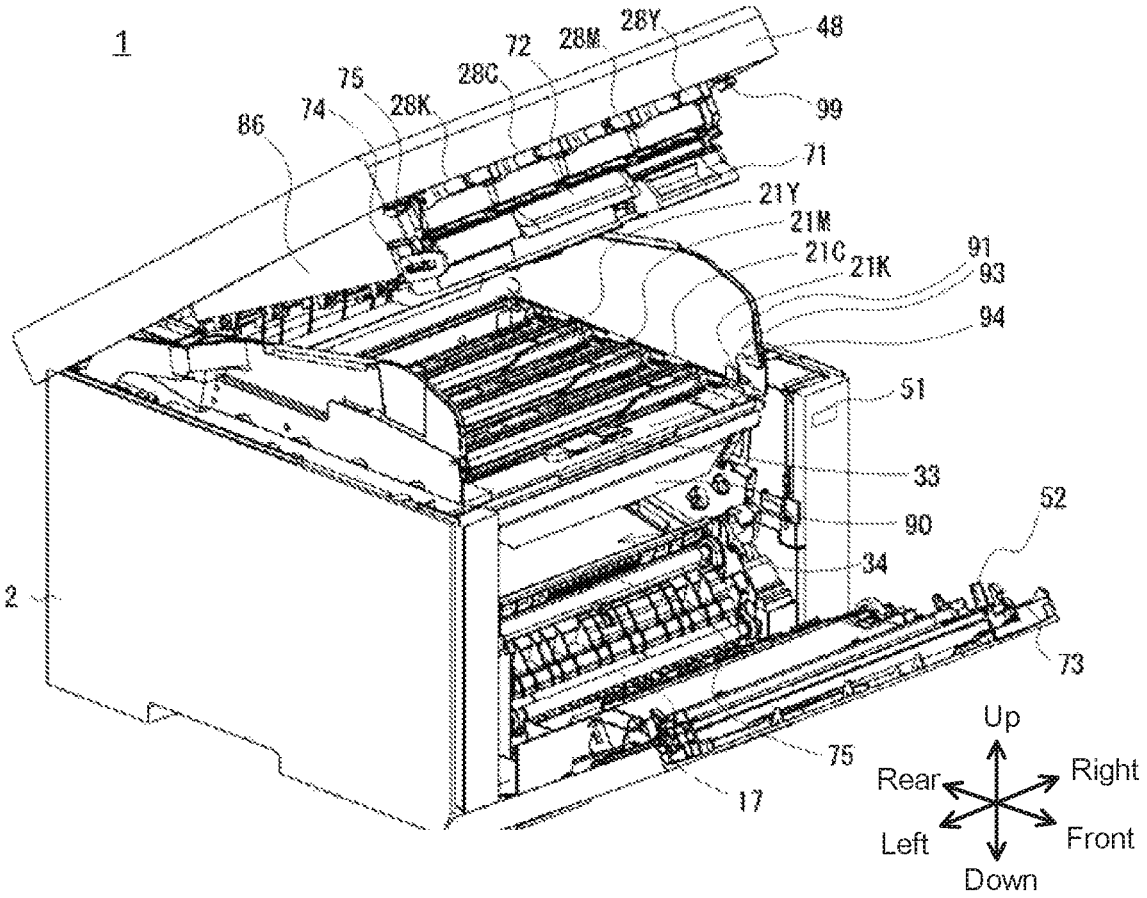
FIG. 6 is a perspective view illustrating an external configuration of the image forming apparatus in a top cover opened state and a basket internally lifted state.
Figure 11:
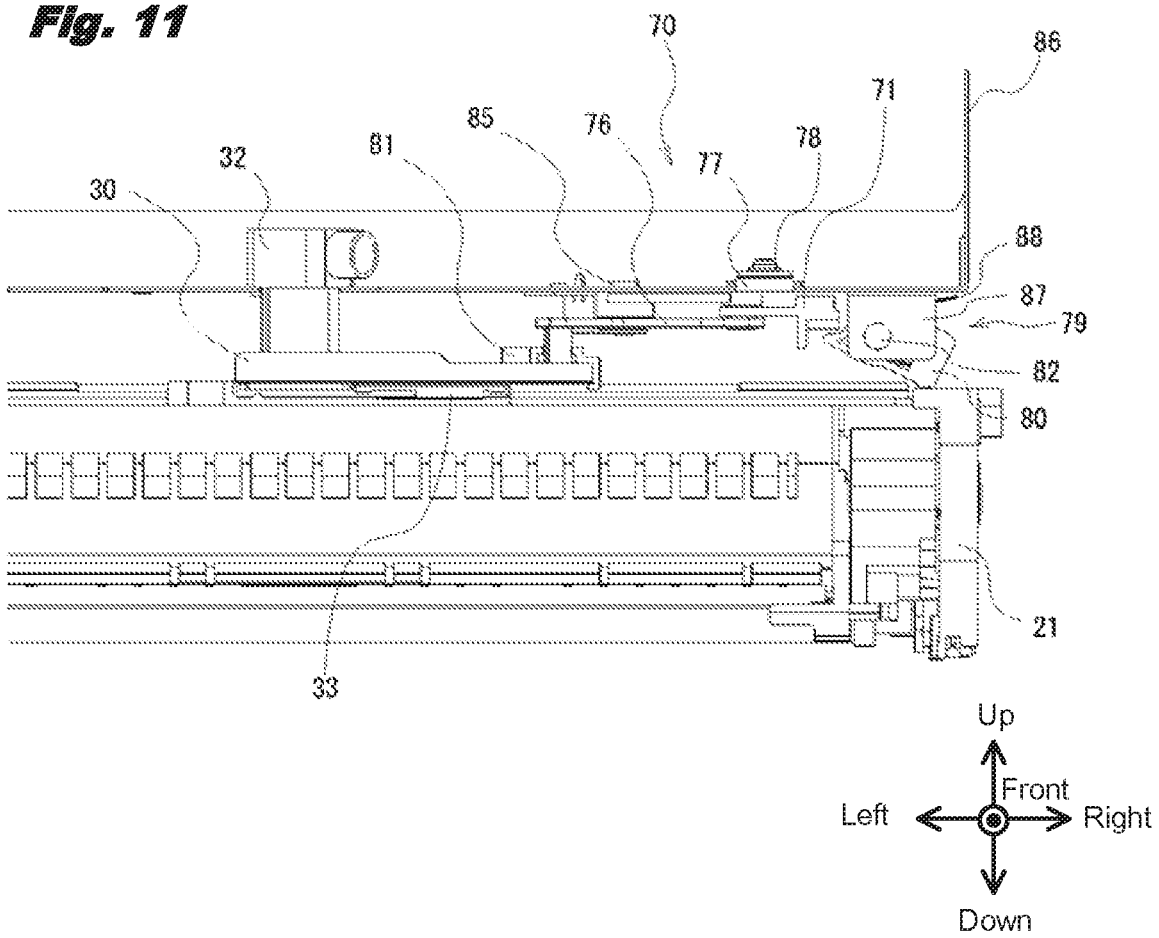
FIG. 11 is a front view illustrating a configuration of a discharge lock mechanism in a process unit in-vicinity state.
Figure 12:
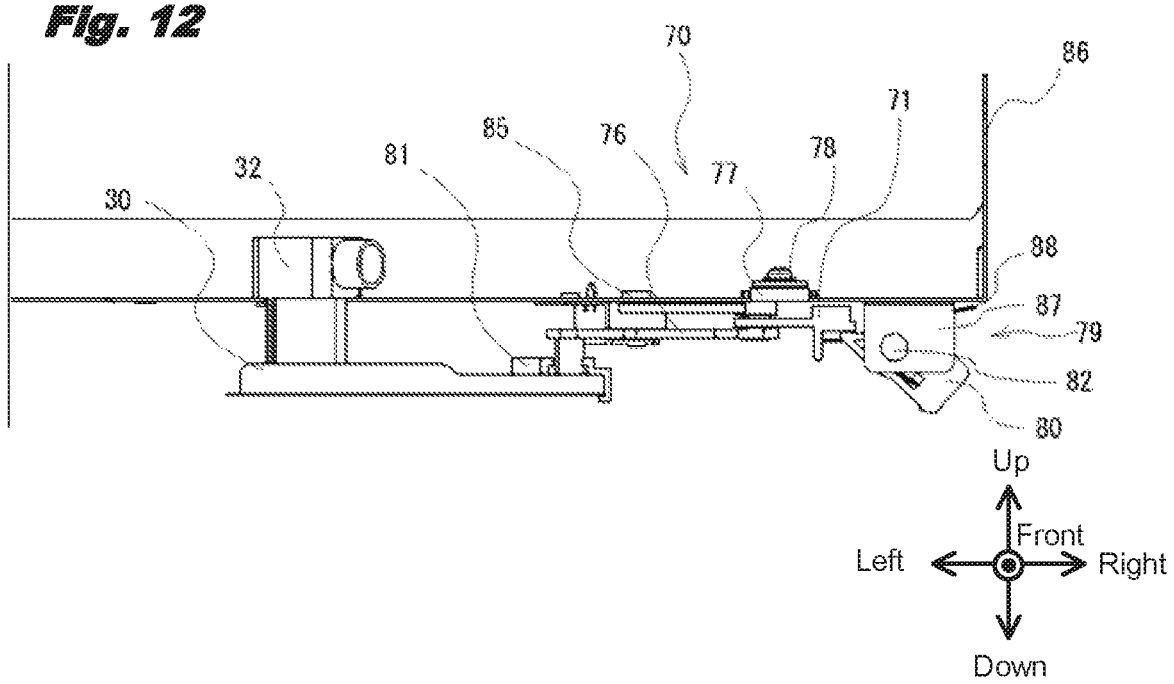
FIG. 12 is a front view illustrating a configuration of an discharge lock mechanism in a process unit separated state.
Figure 19:
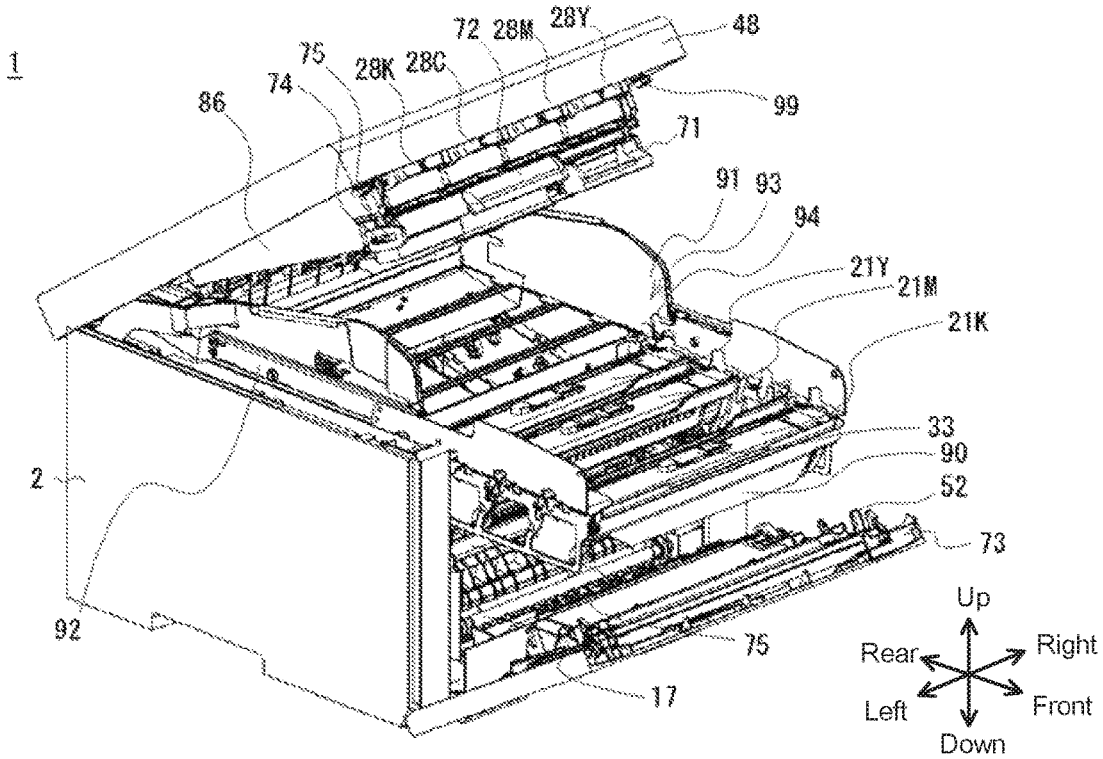
FIG. 19 is a perspective view illustrating an external configuration of the image forming apparatus in a process unit separated state.
Figure 20:
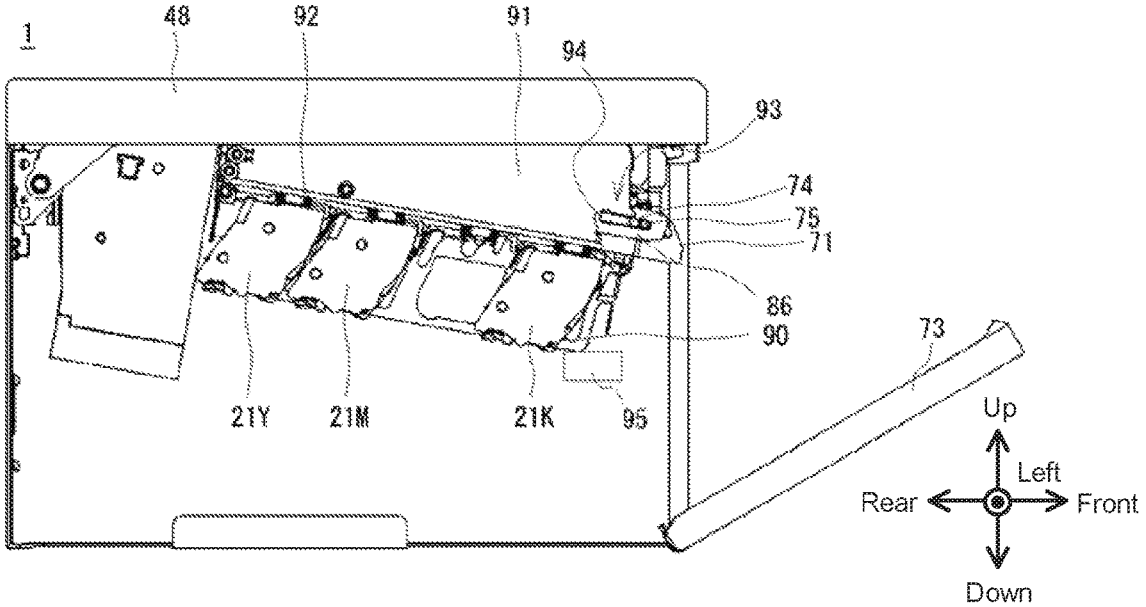
FIG. 20 is a left side view illustrating the configuration of the image forming apparatus in the process unit separated state.

FIGS. 11 and 12 illustrate front views of the shutter link part 70 from the front cover 73 side. Discharge lock mechanisms 79 that lock the shutter handle 71 so that the shutter handle 71 does not move in the front-rear direction are provided on the top frame 86. The discharge lock mechanisms 79 are each mainly formed of a holder 87, an discharge lock lever 80, a biasing member 88 and an engaging part 89. FIG. 11 illustrates a process unit in-vicinity state in which the process units 21 are correctly attached to the basket 90 and thereby the discharge lock levers 80 of the discharge lock mechanisms 79 are respectively in contact with the process units 21. On the other hand, FIG. 12 illustrates a process unit separated state in which the discharge lock levers 80 are respectively separated from the process units 21 to positions above the process units 21, which is a state in which, as illustrated in FIG. 6, by achieving the top cover opened state and the basket internally lifted state, the process units 21 are separated from the top frame 86, or a state in which, as illustrated in FIGS. 19 and 20, the process units 21 are not attached to the basket 90.

Figure 13:
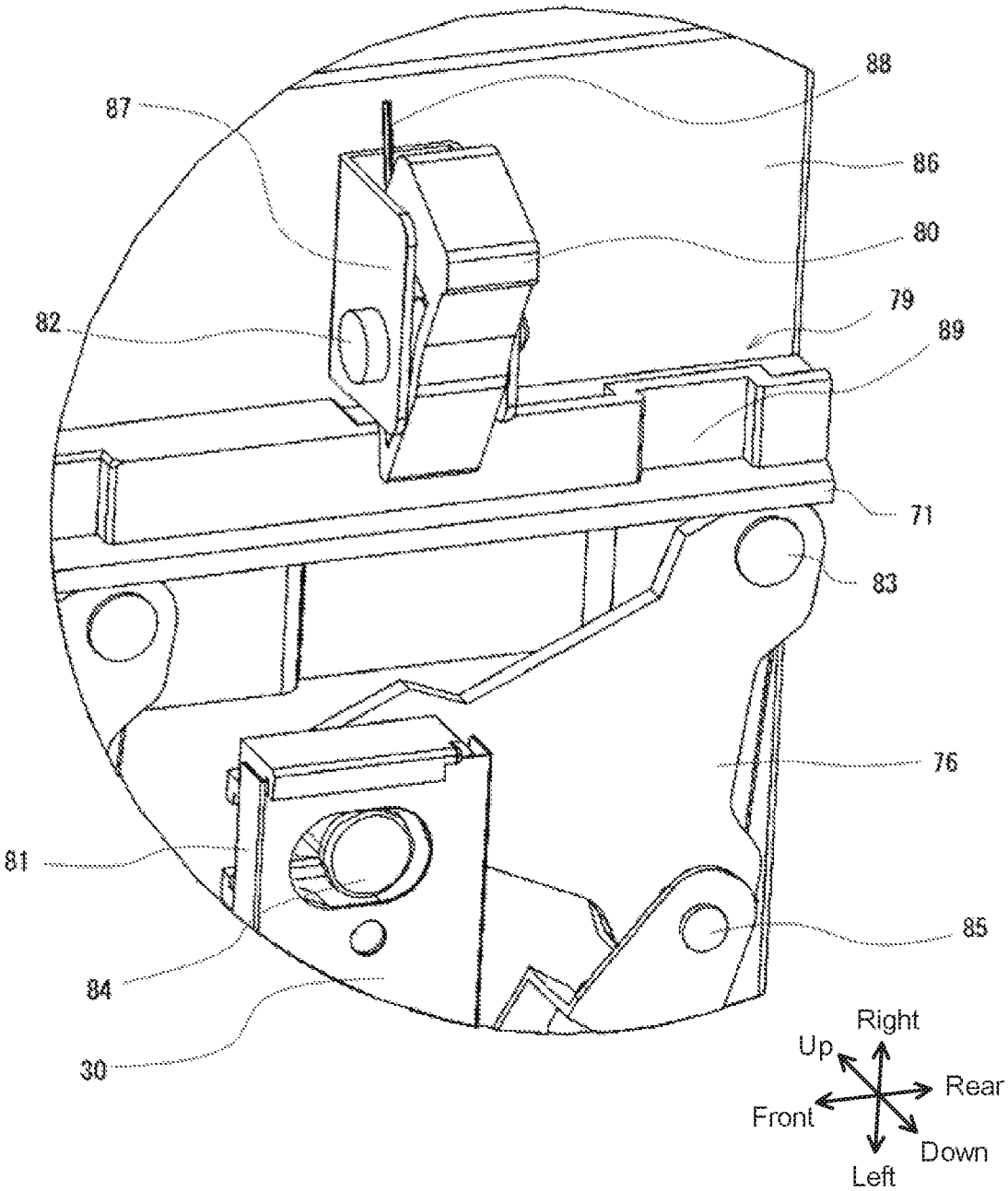
FIG. 13 is a perspective view illustrating a configuration of an discharge lock mechanism in a shutter handle pushed-in state.

The holder 87 arranged on the top frame 86 has the discharge lock lever 80 which is rotatable about a rotation shaft 82. The discharge lock lever 80 is biased clockwise in FIG. 11 by the biasing member 88. In the process unit in-vicinity state (FIGS. 11 and 13), a right end part of the discharge lock lever 80 is in contact with the process unit 21, and thereby, further clockwise rotation thereof is restricted, and a left end part of the discharge lock lever 80 is held at a position not in contact with the engaging part 89 of the shutter handle 71 (FIG. 13). In this case, the discharge lock mechanisms 79 are in a handle push-in allowed state, and the shutter handle 71 is in a state in which the shutter handle 71 in the shutter handle pulled-out state can be pushed in rearward by a user. FIG. 13 is a view penetrating the process units 21 which are actually present.

Figure 14:
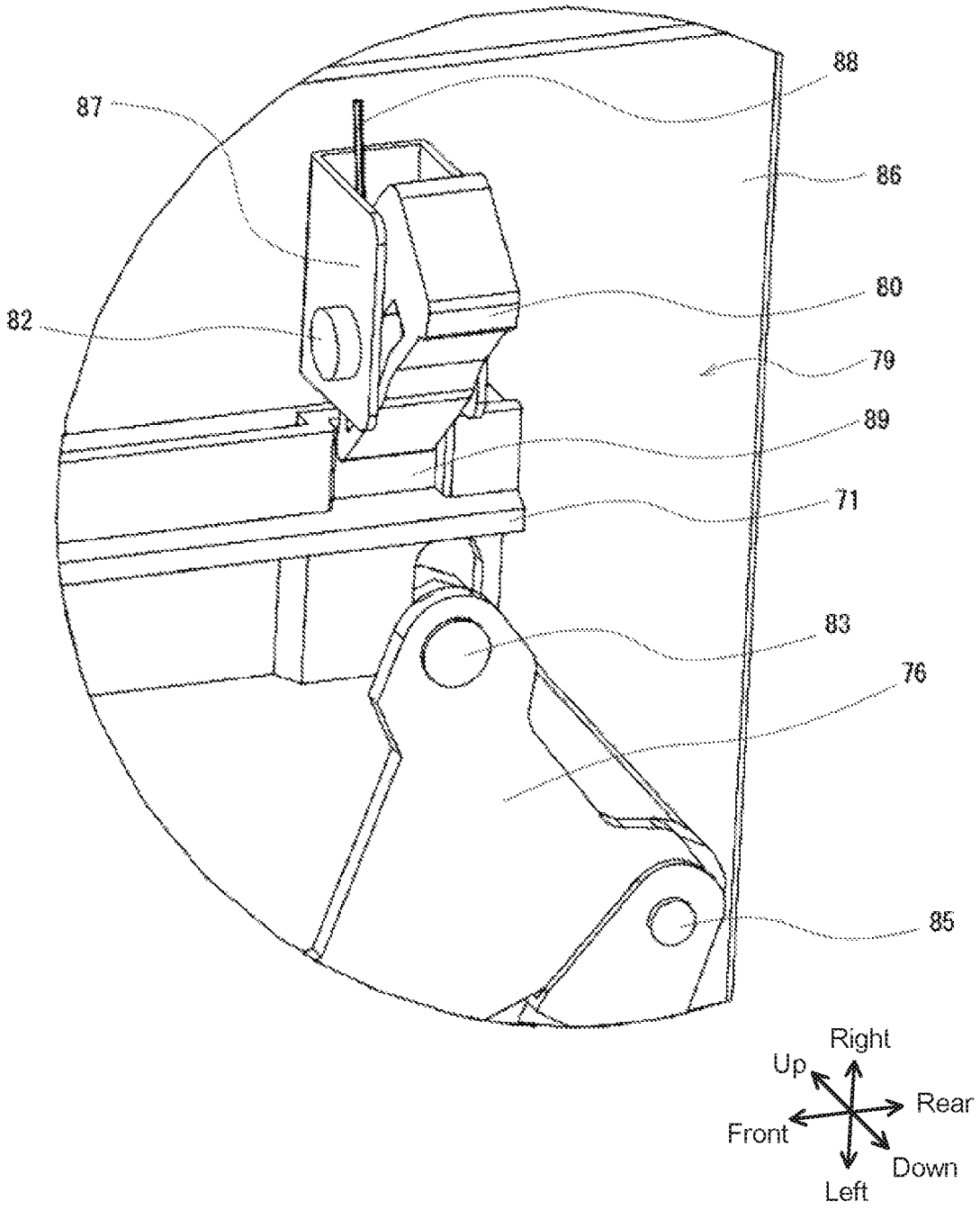
FIG. 14 is a perspective view illustrating a configuration of an discharge lock mechanism in a shutter handle pulled-out state.

On the other hand, in the process unit separated state (FIGS. 12 and 14), since the discharge lock lever 80 is not in contact with the process unit 21, the discharge lock lever 80 rotates clockwise in FIG. 12 until the discharge lock lever 80 is in contact with the shutter handle 71. In this case, since the shutter handle 71 is in a pulled out state, the state illustrated in FIG. 14 is achieved. In this case, the discharge lock lever 80 engages with the engaging part 89 provided on the shutter handle 71. In this case, the discharge lock mechanisms 79 are in a handle push-in disallowed state. In the handle push-in disallowed state, when a user tries to operate the shutter handle 71, due to the engagement between the discharge lock levers 80 and the engaging parts 89, movement of the shutter handle 71 is restricted, and the shutter handle 71 does not move rearward.

Therefore, in a state in which the process units 21 (the basket 90) are (is) detachable with respect to the image forming apparatus 1 (FIG. 7) or, in a state in which the process units 21 are not attached (FIGS. 19 and 20), that is, in the non-image forming state, the discharge lock mechanisms 79 can prevent that the shutter handle 71 is pushed in to a deep side of the apparatus by an erroneous operation of a user and the duct shutters 30 open the toner supply ports 31, and toners of the toner carrying part 29 are scattered.

The discharge lock mechanisms 79 are respectively arranged at positions near and above right end parts of the process units 21K, 21C, 21M and 21Y so as to be corresponding to the process units 21, and impose the same restriction on all the process units 21.

6. Configuration of Locking Parts

Figure 15B:
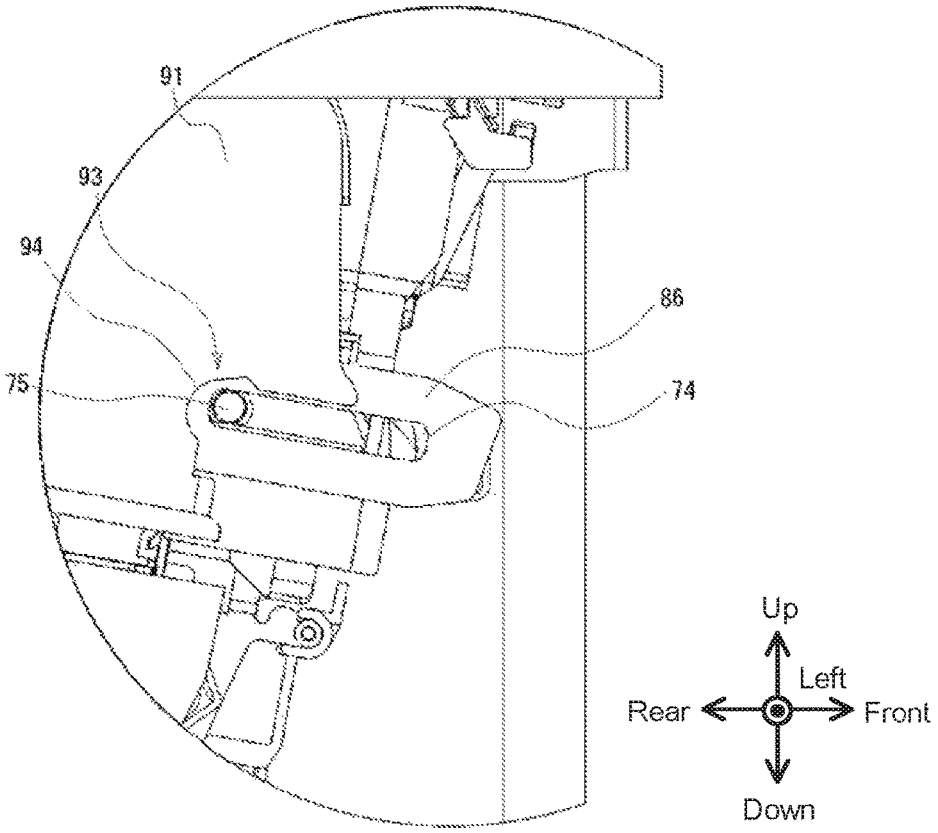

As illustrated in FIGS. 15A and 15B, locking parts 93 causing the top frame 86 and the basket frame 91 to separate from or fit with each other are provided on the top frame 86 and the basket frame 91. The locking parts 93 are each formed of a basket locking part 94, a slide hole 74 and a shaft 75. The basket locking parts 94 are respectively formed at lower ends of left and right front end parts of the basket frame 91. The basket locking parts 94 each have a shape that is recessed toward an upward direction.

The slide holes 74 are respectively formed on left-right direction inner sides of the basket locking parts 94 in the top frame 86. The slide holes 74 are respectively formed by drilling the left and right sheet metals of the top frame 86 in the left-right direction in linear shapes substantially parallel to the horizontal direction in the top cover closed state. In the shutter handle pushed-in state (FIGS. 15A, 15B, 16A and 16B), rear ends of the slide holes 74 are positioned at the same positions in the front-rear direction as the basket locking parts 94, and front ends of the slide holes 74 are positioned on a front side of a front edge part of the top frame 86. The shafts 75 are provided on the shutter handle 71 on the top frame 86 side, and respectively penetrate through the left and right slide holes 74 in the left-right direction. Each of the shafts 75 is movable in a manner sliding between a front end and a rear end inside a slide hole 74.

In such a configuration, in the top cover closed position and the shutter handle pushed-in state illustrated in FIGS. 15A and 15B, since the shutter handle 71 is pushed in to the deep side of the apparatus, the shafts 75 are positioned the rear end parts of the slide holes 74. FIGS. 15B, 16B, 17B and 18B are respectively enlarged views of circled portions in FIGS. 15A, 16A, 17A and 18A. In this case, the slide holes 74 are each in a state of slightly forwardly descending relative to the horizontal direction. Further, a lower end of the front end part of the basket frame 91 is in contact with a case side contact part 95 fixed to the case 2, and further rotation in the top cover closing direction is restricted. On the other hand, the top frame 86 is not in contact with the case side contact portion 95, and further rotation in the top cover closing direction is not restricted. Therefore, the basket frame 91 is in a state of being slightly rotated to the top cover opening direction side relative to the top frame 86. Therefore, in the basket frame 91, the basket locking parts 94 are positioned above the shafts 75 so that the basket locking parts 94 are not locked by the shafts 75, and the basket frame 91 does not enter into the slide holes 74. Therefore, the locking parts 93 are in a locking part non-locked state which is a state in which the shafts 75 are movable from the rear end parts to the front end parts of the slide holes 74. Further, in this state, when the top frame 86 is slightly lifted, the shafts 75 engage with the basket locking parts 94, and thereby, the locking part locked state is achieved in which the top frame 86 and the basket frame 91 are fitted with each other and are integrated.

Here, when a user removes a jammed sheet or replaces the transfer belt unit 34, as illustrated in FIGS. 16A and 16B, in the shutter handle pushed-in state, that is, with the shafts 75 being positioned at the rear end parts of the slide holes 74, the basket frame 91 is lifted together with the top frame 86 from the state of FIGS. 15A and 15B, and is rotated in the top cover opening direction. In this case, since the basket frame 91 tends to rotate in the top cover closing direction due to its own weight and the top frame 86 is biased in the top cover opening direction by the biasing member, the shafts 75 enter into and engage with the basket locking parts 94, and the locking part locked state is achieved. In the locking part locked state, even when a user tries to pull the shutter handle 71 forward, since the shafts 75 have entered into the basket locking parts 94, the shutter handle 71 does not move forward. Therefore, in the shutter handle pushed-in state, when the top frame 86 and the basket frame 91 are lifted, the locking parts 93 can prevent the shutter handle 71 from being pulled out to the front side of the apparatus to be in the shutter handle pulled-out state. As a result, when the top frame 86 and the basket frame 91 are integrally lifted, that is, when the top cover 48 and the process units 21 are integrally rotated in the top cover opening direction, the locking parts 93 can prevent the shutter handle 71 from being pulled out to the front side of the apparatus due to an erroneous operation of a user, thereby preventing the top frame 86 and the basket frame 91 from being disengaged with each other and preventing the process units 21 from being dropped.

Figure 17A:
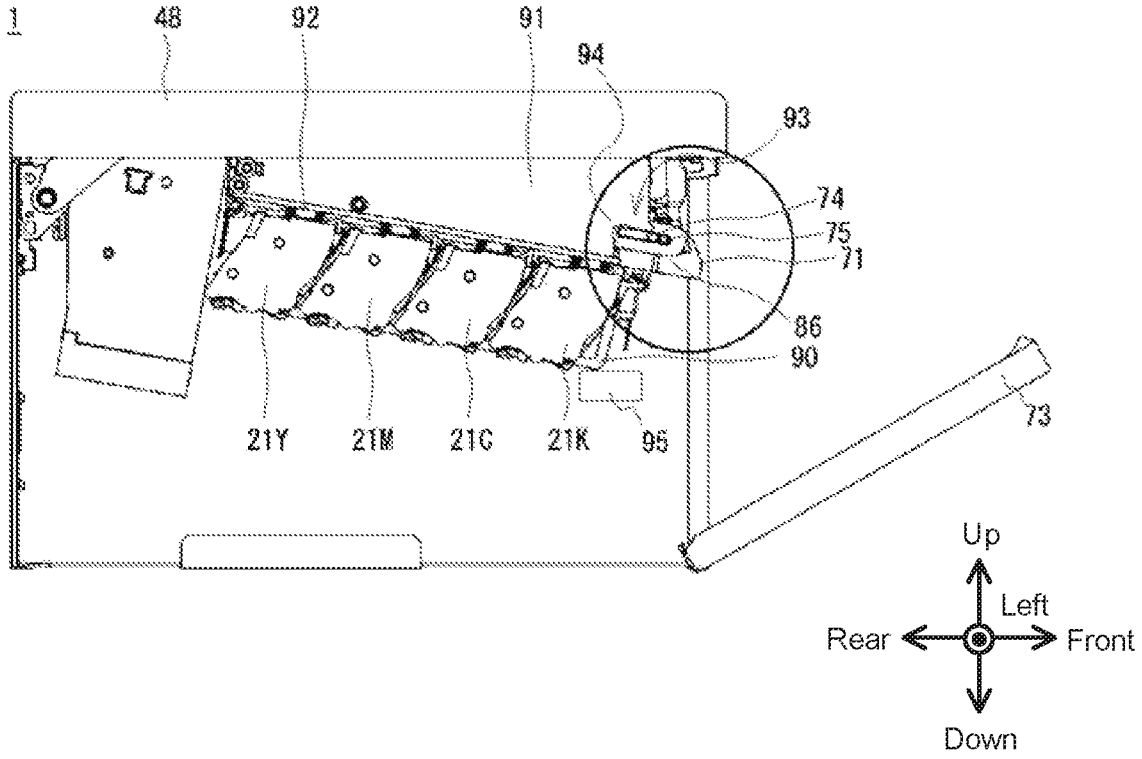
FIGS. 17A and 17B illustrate the configuration of the image forming apparatus in a locking part released state.
Figure 17B:
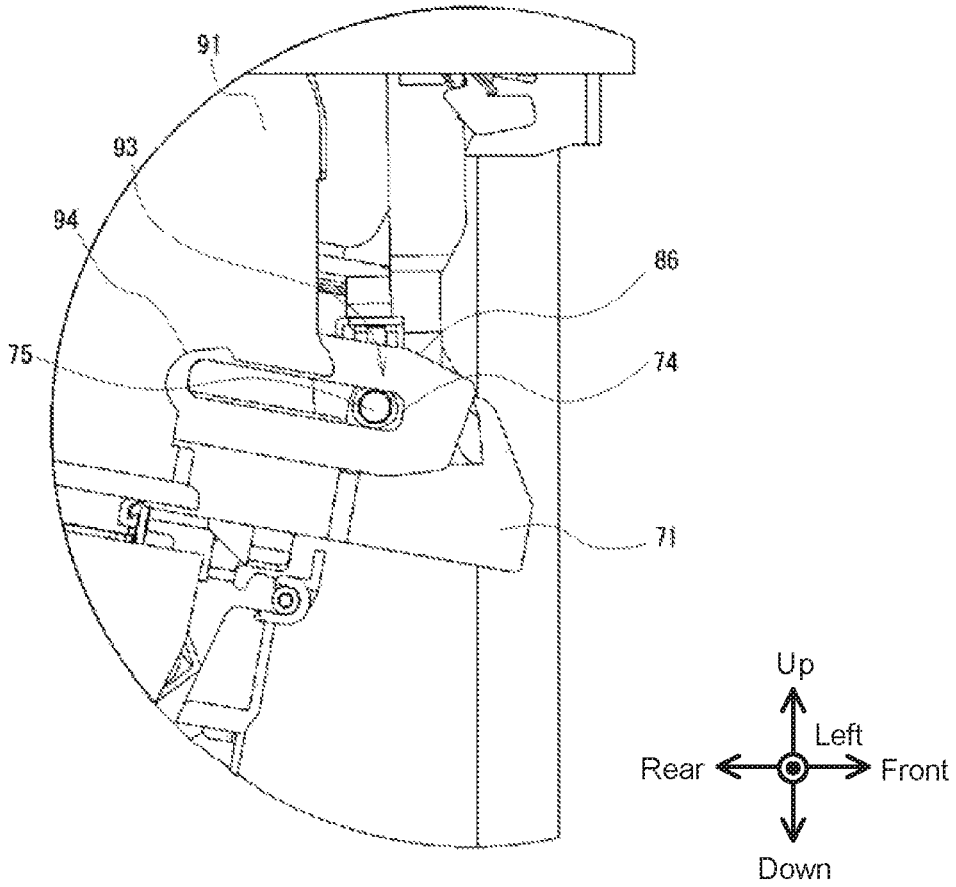

On the other hand, in the shutter handle pulled-out state illustrated in FIGS. 17A and 17B, since the shutter handle 71 has been pulled out from the state illustrated in FIGS. 15A and 15B to the front side of the apparatus, the shafts 75 are positioned at the front end parts of the slide holes 74. In this state, since the shafts 75 are positioned on a front side of the front edge of the basket frame 91, the shafts 75 are disengaged from the basket locking parts 94, and the locking part released state is achieved in which the basket frame 91 and the top frame 86 are physically separated from each other and can move independently of each other.

When the handle 72 (FIG. 4) is pulled out forward from this state and then the top cover 48 is lifted upward, the image forming apparatus 1 is in the top cover opened state and the basket internally lifted state in which the shafts 75 remain in the state of being positioned at the front end parts of the slide holes 74 as illustrated in FIGS. 18A and 18B.

7. Toner Cartridge Replacement Procedure

Figure 22:
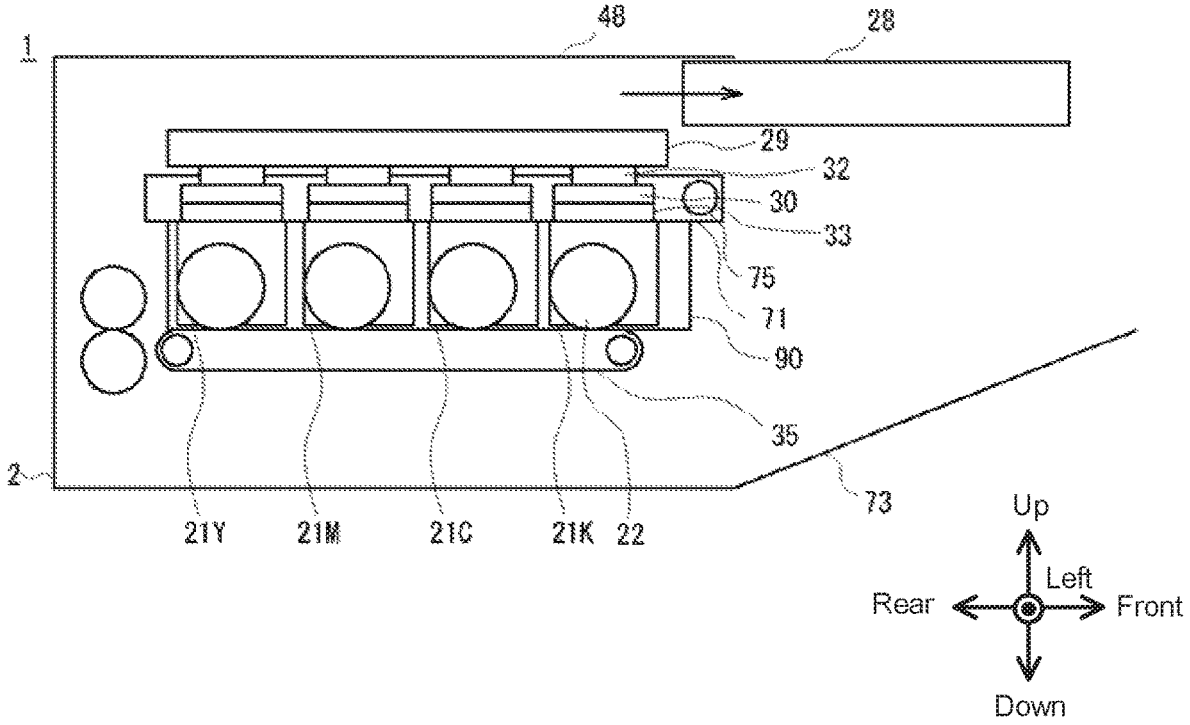
FIG. 22 is a left side view illustrating a simplified configuration of the image forming apparatus when a toner cartridge is replaced.
Figure 23:
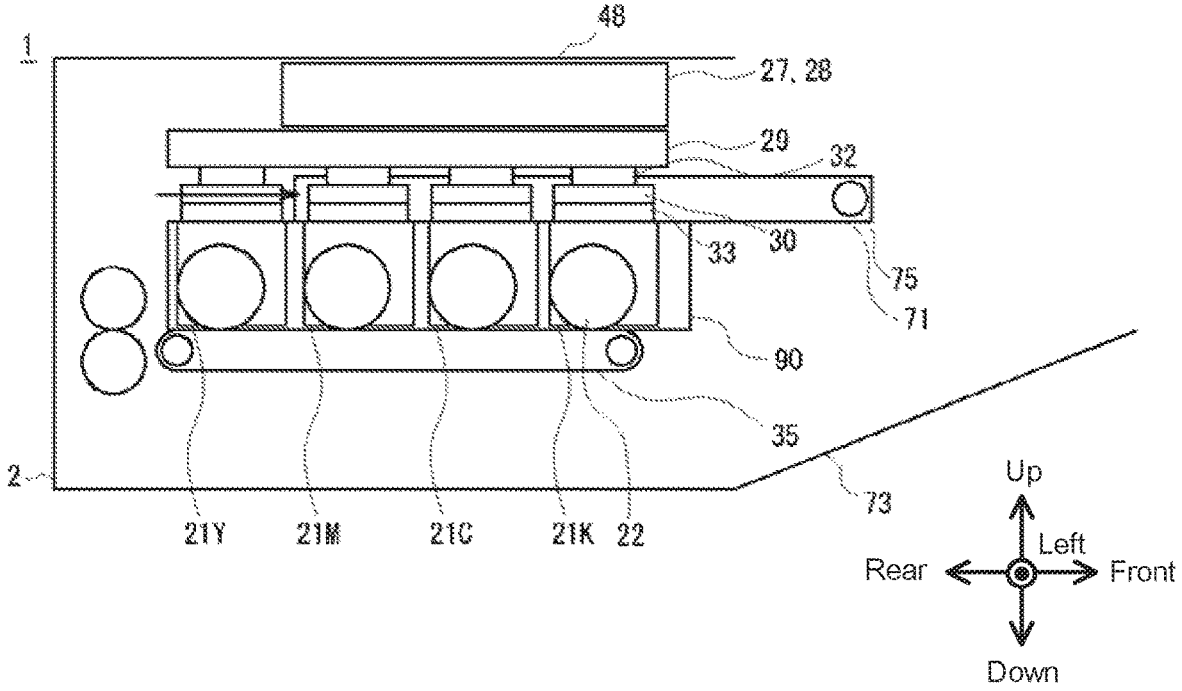
FIG. 23 is a left side view illustrating a simplified configuration of the image forming apparatus in a shutter handle pulled-out state when a process unit is replaced.

Next, a procedure for a user to replace the toner cartridges 28 is described. First, in the cover closed state (FIGS. 3, 21A and 21B), when the user opens the front cover 73, the image forming apparatus 1 transitions to the front cover opened state illustrated in FIGS. 4, 15A and 15B. Next, as illustrated in FIG. 22, the user pulls out the toner cartridges 28 forward along the horizontal direction, the toner cartridges 28 attached to the toner container 27 are exposed to the outside of the image forming apparatus 1, and the toner cartridges 28 are each in a detachable state. In this state, the user performs replacement of any one of the toner cartridges 28, and then pushes back the toner cartridges 28 to a deep side of the apparatus. After that, the user closes the front cover 73 to achieve the cover closed state (FIGS. 3, 21A and 21B), and the replacement of the toner cartridges 28 is completed.

8. Process Unit Replacement Procedure

Next, a procedure for a user to replace the process units 21 is described. First, in the cover closed state (FIGS. 3, 21A and 21B), when the user opens the front cover 73, the image forming apparatus 1 transitions to the front cover opened state illustrated in FIGS. 4, 15A and 15B. In the front cover opened state, the shutter handle 71 and the handle 72 are exposed to the outside of the image forming apparatus 1. Next, when the user pulls out the shutter handle 71 forward from the shutter handle pushed-in state illustrates in FIG. 9, the image forming apparatus 1 transitions to the shutter handle pulled-out state illustrated in FIGS. 5, 10, 17A, 17B and 23. In this case, when the shutter handle 71 is guided by the sliders 77 and moves horizontally forward, the link engaging shafts 83 of the four link levers 76 linked to the shutter handle 71 move forward. Therefore, the link levers 76 respectively rotate clockwise in a plan view about the lever rotation shafts 85, and the shutter operation shafts 84 also move to rotate clockwise in a plan view. The fitting parts 81 are respectively moved by the shutter operation shafts 84 which rotate clockwise in a plan view, and, together with the duct shutters 30, move in a direction parallel to the shutter closing direction which is the left direction among directions perpendicular to the movement direction of the shutter handle 71.

Here, in the shutter handle pushed-in state (FIG. 9), the duct shutters 30 are positioned at opening positions, and the toner supply ports 31 respectively provided in the ducts 32 are opened, and thereby, a state is achieved in which toners supplied from the toner carrying part 29 can be supplied to the process units 21. In this case, the shutters 33 blocking toner receiving ports provided in the process units 21 are interlocked with the duct shutters 30, and the ducts 32 are respectively communicatively connected to the process units 21, and toners can be supplied. This state is also called a shutter opened state.

On the other hand, in the shutter handle pulled-out state illustrated in FIG. 10 in which the shutter handle 71 is pulled out in order to take out the process units 21, the duct shutters 30 are moved in the shutter closing direction to closing positions to block the toner supply ports 31, and thereby, a state is achieved in which toners of the toner carrying part 29 are not supplied to the process units 21. This state is also called a shutter closed state. In this case, the shutters 33 are respectively interlocked with the duct shutters 30, and respectively block the toner receiving ports on the process units 21 side. As a result, the image forming apparatus 1 prevents the toners from leaking and scattering from the toner supply ports 31 of the ducts 32.

Further, here, in the shutter handle pushed-in state in the top cover closed state, as illustrated in FIGS. 15A and 15B, the shafts 75 are positioned at the rear end parts of the slide holes 74 and are positioned below the basket locking parts 94, and the locking part non-locked state is achieved. In the locking part non-locked state, when the shutter handle 71 is pulled out, the shafts 75 provided on the shutter handle 71 are guided together with the shutter handle 71 by the slide holes 74 to move in a slightly forwardly descending direction with respect to the horizontal direction toward a shaft non-locking direction which is a forward direction.

Figure 24:
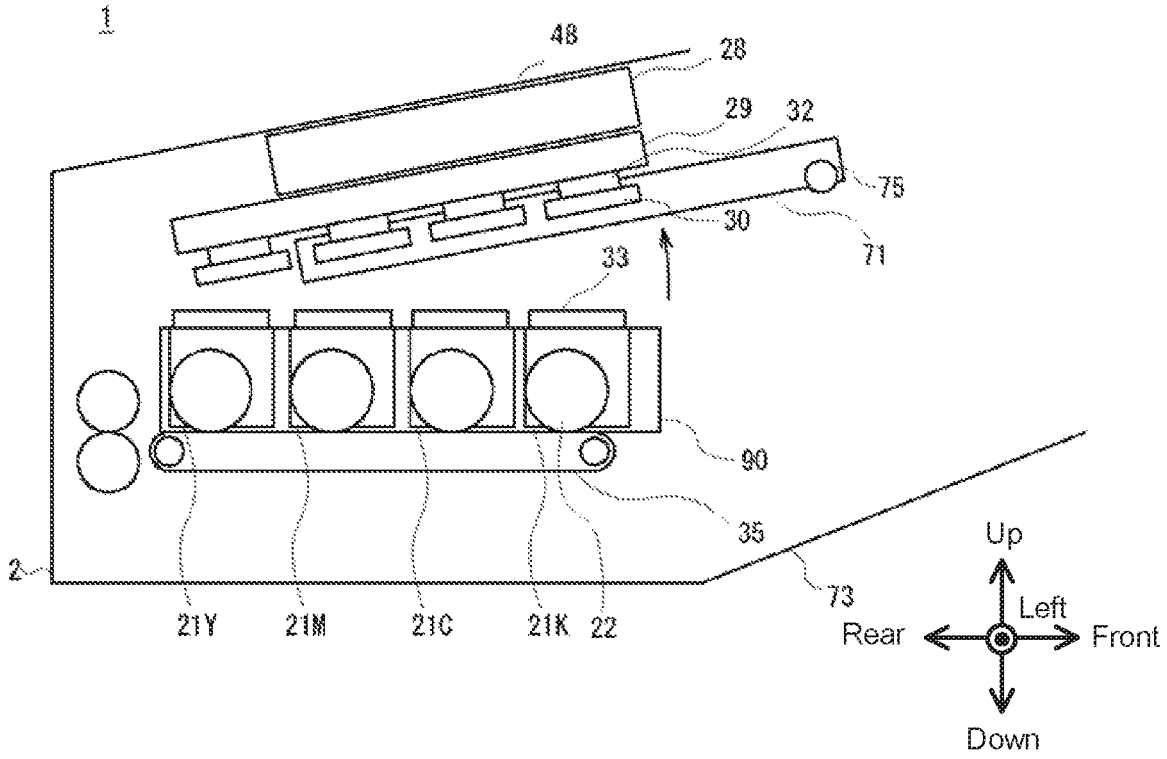
FIG. 24 is a left side view illustrating a simplified configuration of the image forming apparatus in a top cover opened state when a process unit is replaced.
Figure 25:
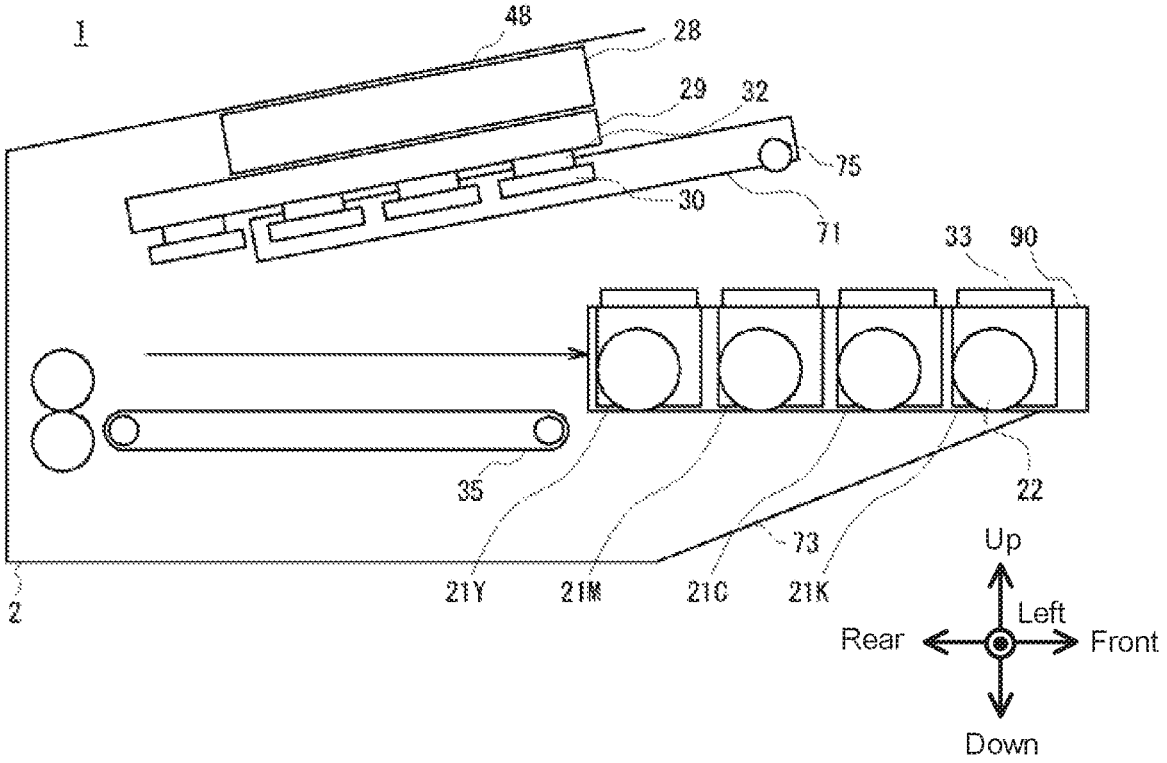
FIG. 25 is a left side view illustrating a simplified configuration of the image forming apparatus in a basket pulled-out state when a process unit is replaced.

When eventually the shutter handle pulled-out state is achieved, as illustrated in FIGS. 17A and 17B, the shafts 75 are positioned so as to be pulled out to the front side of the slide holes 74, and the locking part released state is achieved. In the locking part released state, since the shafts 75 and the basket frame 91 are disengaged, a state is achieved in which the top frame 86 and the basket frame 91 are disengaged. In the locking part released state, when the user operates the handle 72, as illustrated in FIGS. 18A, 18B and 24, in the state in which the top frame 86 is detached from the basket frame 91, only the top frame 86 rotates, and the top cover opened state is achieved with the basket internally lifted state being maintain as illustrated in FIGS. 18A and 18B.

In this way, when the process units 21 are replaced, after pulling out the shutter handle 71 forward, the user operates the handle 72, and thereby, the image forming apparatus 1 is in the top cover opened state and the basket internally lifted state. In the basket internally lifted state and the top cover opened state, when the user pulls out the basket 90 to the front side of the apparatus, the image forming apparatus 1 transitions from the basket internally lifted state to the basket pulled-out state which is the non-image forming state illustrated in FIGS. 7 and 25. In the basket pulled-out state, the process units 21 are exposed to the outside of the image forming apparatus 1, and the process units 21 are in a state of being detachable by a user. The user performs replacement of any one of the process units 21 in the basket pulled-out state, and then pushes the basket 90 back to the deep side of the apparatus to restore the basket internally lifted state (FIGS. 18A, 18B and 24). After that, the user closes the top cover 48 to restore the top cover closed state (FIG. 23), and then, pushes the shutter handle 71 to the deep side of the apparatus to restore the shutter handle pushed-in state (FIGS. 4, 15A and 15B), and then, closes the front cover 73 to restore the cover closed state (FIGS. 3, 21A and 21B), and the replacement of the process units 21 is completed.

Figure 7:
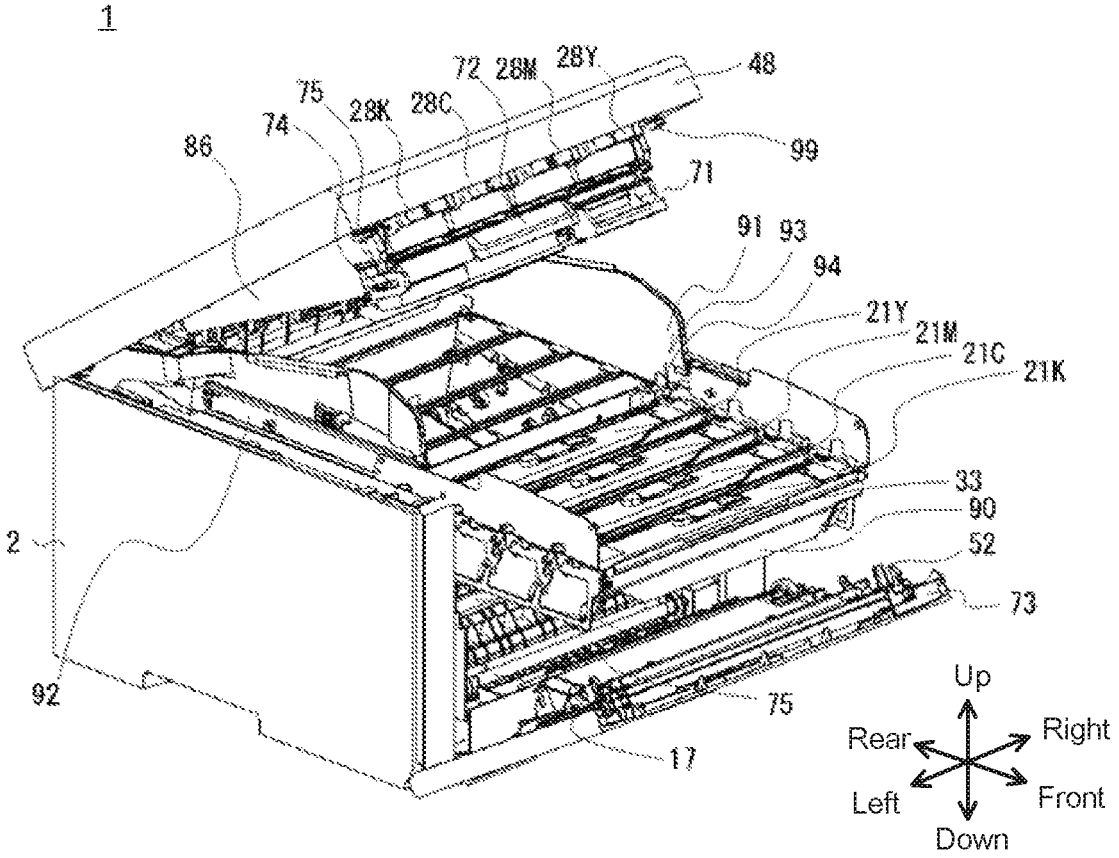
FIG. 7 is perspective view illustrating an external configuration of the image forming apparatus in a basket pulled out state.
Figure 8:
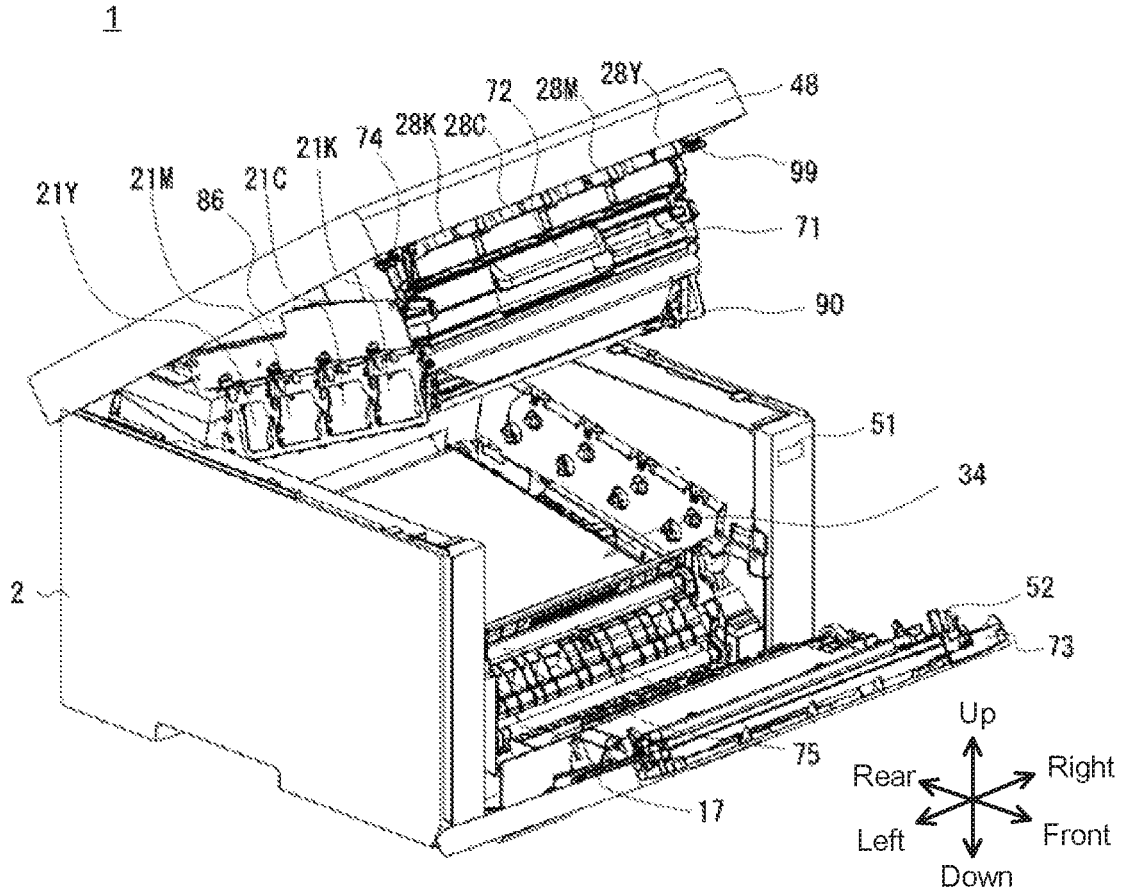
FIG. 8 is a perspective view illustrating an external configuration of the image forming apparatus in a top cover opened state and a basket externally lifted state.

In such a series of operations in the process unit replacement procedure, the toner supply ports 31 of the ducts 32 are respectively blocked by the duct shutters 30, and thus, the toners do not leak to the outside. However, in a state in which the top frame 86 and the basket frame 91 are separated from each other as illustrated in FIG. 6, in a state in which the basket 90 has been pulled out as illustrated in FIG. 7, and in a state in which a user pushes back the basket 90 into the apparatus without attaching one of the process units 21 to the basket 90 and closes the top cover 48 as illustrated in FIG. 20, when a user pushes back the shutter handle 71 to the deep side of the apparatus, there is a possibility that the duct shutters 30 move in a direction parallel to the shutter opening direction which is the right direction, and the toner supply ports 31 are opened, causing the toners to leak from the ducts 32. In contrast, in the image forming apparatus 1, that the shutter handle 71 in the shutter handle pulled-out state is unexpectedly pushed rearward to achieve the shutter handle pushed-in state and to cause the toner supply ports 31 to open is prevented by the discharge lock mechanisms 79.

That is, as described above, in the process unit separated state (FIGS. 12 and 14), the discharge lock levers 80 are in the handle push-in disallowed state. Therefore, in the handle push-in disallowed state, even when a user tries to push in the shutter handle 71, since the discharge lock levers 80 are engaged with the engaging parts 89, the shutter handle 71 does not move rearward. Therefore, in the image forming apparatus 1, in the shutter handle pulled-out state, the shutter handle 71 can be prevented from being unexpectedly pushed in rearward to be in the shutter handle pushed-in state, thereby preventing the toner supply ports 31 from being opened.

9. Jammed Sheet Removal Procedure and Transfer Belt Unit Replacement Procedure Next, a procedure for a user to remove a jammed sheet jammed between the process units 21 and the transfer belt 35 and a procedure for replacing the transfer belt unit 34 are described. First, in the cover closed state (FIGS. 3, 21A and 21B), when the user opens the front cover 73, the image forming apparatus 1 transitions to the front cover opened state illustrated in FIG. 4. In the front cover opened state, the shutter handle 71 and the handle 72 are exposed to the outside of the image forming apparatus 1.

Figure 26:
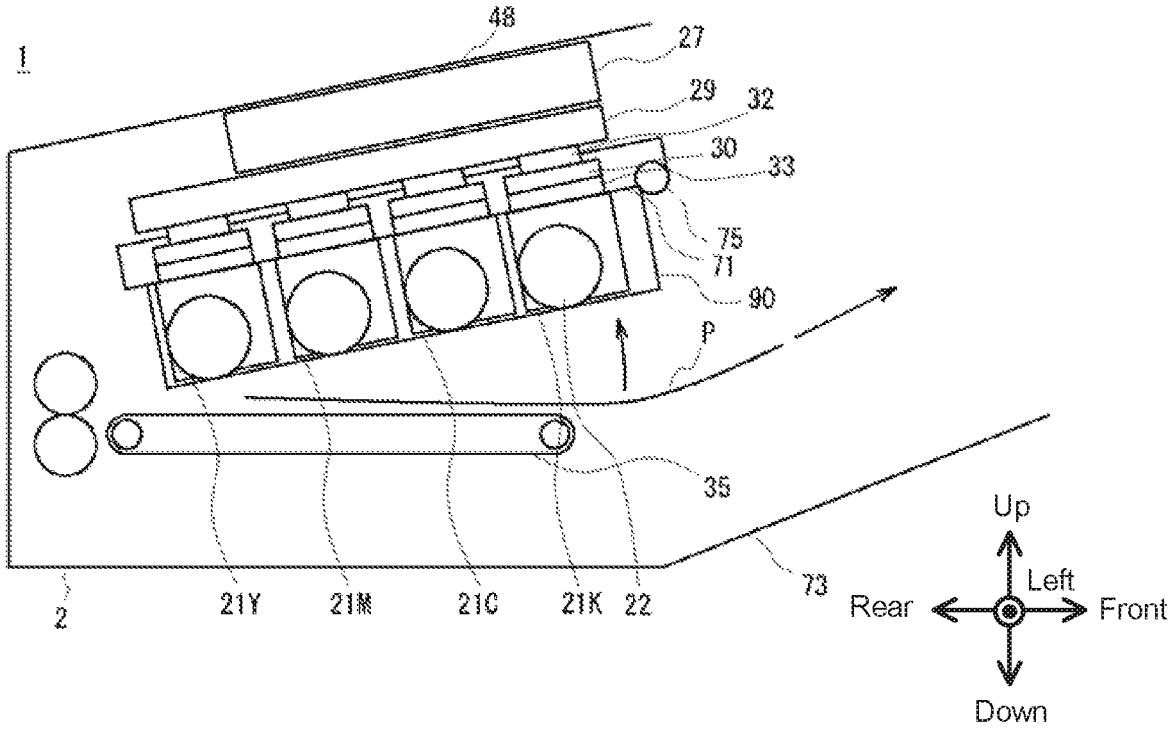
FIG. 26 is a left side view illustrating a simplified configuration of the image forming apparatus when a jammed sheet is removed.

Further, here, in the shutter handle pushed-in state (FIG. 9), as illustrated in FIGS. 15A and 15B, the shafts 75 are positioned at the rear sides of the slide holes 74 and are engaged with the basket frame 91, and the locking part non-locked state is achieved. In the locking part non-locked state, when the user operates the handle 72, as illustrated in FIGS. 16A, 16B and 26, the top frame 86 side and the basket frame 91 simultaneously rotate while engaging with each other, and the top cover opened state and the basket externally lifted state, which are non-image forming states, are achieved. In the top cover opened state and the basket externally lifted state, since the lower end part of the basket 90 is separated upward from the transfer belt 35, the user can remove a jammed sheet or replace the transfer belt unit 34.

In this way, in the image forming apparatus 1, in the shutter handle pushed-in state, when the user simply operates the handle 72, the top frame 86 side and the basket 90 simultaneously rotate while engaging each other, and the top cover opened state and the basket externally lifted state are achieved, and the user can easily remove a jammed sheet or replace the transfer belt unit 34 without being forced to perform a complicated work.

Further, in the image forming apparatus 1, in the top cover opened state, the shafts 75 are inserted into and engaged with the basket locking parts 94, and the locking part locked state is achieved. Therefore, in the image forming apparatus 1, the shutter handle 71 is prevented from being pulled out to the front side of the apparatus to be in the shutter handle pulled-out state. As a result, in the image forming apparatus 1, the shutter handle 71 can be prevented from being pulled out to the front side of the apparatus due to an erroneous operation by a user, thereby preventing the top frame 86 and the basket frame 91 from being disengaged with each other and preventing the process units 21 from being dropped.

10. Operation and Effect and the Like

In the above-described configuration, in the image forming apparatus 1, when a user replaces the process units 21, in the process unit separated state (FIGS. 11 and 13), the discharge lock levers 80 are in the handle push-in disallowed state. Therefore, in the image forming apparatus 1, even when the user tries to push in the shutter handle 71, since the discharge lock levers 80 are engaged with the engaging parts 89, the shutter handle 71 cannot be moved rearward. Therefore, in the image forming apparatus 1, in the shutter handle pulled-out state, the shutter handle 71 can be prevented from being pushed in rearward by an erroneous operation to be in the shutter handle pushed-in state, thereby preventing the toner supply ports 31 from being opened. Thus, in the image forming apparatus 1, the toners of the toner carrying part 29 can be prevented from scattering.

In this way, in the image forming apparatus 1, in the non-image forming state such as the case where the process units 21 (the basket 90) are (is) detachable (FIGS. 6 and 7) and the case of the process unit separated state (FIG. 19 and FIG. 20) in which the process units 21 are not attached to the basket 90, the supply ports of the toner cartridges 28 can be prevented from being opened, thereby preventing the toners from being scattered.

Further, in the image forming apparatus 1, when a user removes a jammed sheet or when a user replaces the transfer belt unit 34, in the case where the basket frame 91 is lifted together with the top frame 86 and is rotated in the top cover opening direction while the shutter handle pushed-in state is maintained, the shafts 75 are locked inside the basket locking parts 94 and the locking part locked state is achieved. Therefore, in the image forming apparatus 1, even when a user tries to pull shutter handle 71 due to an erroneous operation, since the shafts 75 have entered into the basket locking parts 94, the shutter handle 71 cannot move to the front side. Thus, in the image forming apparatus 1, the top frame 86 and the basket frame 91 are prevented from being disengaged with each other, thereby preventing the process units 21 from being dropped.

In this way, in the image forming apparatus 1, in the non-image forming state such as the case where the basket frame 91 is lifted together with the top frame 86 and the process units 21 is separated upward from the transfer belt 35, the top frame 86 and the basket frame 91 can be prevented from being disengaged with each other, thereby preventing the process units 21 from being dropped.

Further, in the image forming apparatus 1, in the shutter handle pulled-out state (FIG. 20), closing the front cover 73 in an opened state is physically interfered by the shutter handle 71 and the front cover 73 cannot be rotated to the front cover closed state, and, when pushing the shutter handle 71 to the deep side to achieve the shutter handle pushed-in state, the front cover 73 no longer physically interferes with the shutter handle 71 and can be rotated to the front cover closed state.

Here, when even one of the process units 21 is not attached to the basket 90, since the discharge lock mechanism 79 corresponding to the process unit 21 that is not attached is in the handle push-in disallowed state, transition from the shutter handle pulled-out state to the shutter handle pushed-in state is not possible. Therefore, in the image forming apparatus 1, when even one of the process units 21 is forgotten to be attached to the basket 90, the front cover 73 cannot be closed. Therefore, in the image forming apparatus 1, for a user who has replaced the process units 21 and tries to close the front cover 73, that the front cover 73 comes into contact with the shutter handle 71 and does not close can remind the user that at least one of the process units 21 is forgotten to be attached.

Further, in the image forming apparatus 1, opening and closing of the duct shutters 30 and attachment and detachment of the basket frame 91 and the top frame 86 are performed by operating the one shutter handle 71 along the front-rear direction. Therefore, in the image forming apparatus 1, the opening and closing of the duct shutters 30 and the attachment and detachment of the basket frame 91 and the top frame 86 can be integrated with the one shutter handle 71 without being performed using separate operation parts, and thus, the configuration can be simplified to downsize the image forming apparatus 1, and the operation of the user can be simplified.

According to the above-described configuration, the image forming apparatus 1 includes: the case 2; the process units 21 that are detachable from the case 2; the shutter handle 71 for allowing the process units 21 to be detached from the case 2; and the discharge lock mechanisms 79 and the locking parts 93 that lock the shutter handle 71 in a case of a first state which is not the image forming state in which the process units 21 can form an image on the print sheet P as a medium, and unlock the shutter handle 71 in a case of a second state which is the image forming state.

That is, in the image forming apparatus 1, when the process units 21 are replaced, by achieving the shutter handle pulled-out state, the shutter closed state, and the top cover opened state, the process unit separated state, that is, the non-image forming state is achieved. In the case of the state (FIGS. 7 and 8) in which the process units 21 are detachable from the image forming apparatus 1, or in the case of the non-image forming state which is a state in which the process units 21 are not attached (FIGS. 21A, 21B and 22), due to the discharge lock mechanisms 79, the discharge lock levers 80 engage with the engaging parts 89, and the shutter handle 71 is locked so that the shutter handle 71 cannot be pushed in.

Further, in the image forming apparatus 1, when a jammed sheet is removed or the transfer belt unit is replaced, by achieving the top cover opened state while maintaining the shutter handle pushed-in state, the non-image forming state is achieved in which the process units 21 are separated from the transfer belt 35. In this case, due to the locking parts 93, the shafts 75 enter into and engage with the basket locking parts 94, and the shutter handle 71 is locked so that the shutter handle 71 cannot be pulled out.

As a result, in the image forming apparatus 1, in the case of the non-image forming state, the shutter handle 71 is locked so that the shutter handle 71 cannot be operated, and thus, an erroneous operation of the shutter handle 71 can be prevented.

11. Other Embodiments

In the above-described embodiment, the case is described in which when the basket 90 (the process units 21) is (are) pulled out to the outside of the image forming apparatus 1, the top cover 48 is rotated in advance in the top cover opening direction (FIG. 24). Embodiments of the present invention are not limited to this. It is also possible that, without rotating the top cover 48 in the top cover opening direction, the basket 90 (process units 21) is (are) pulled out to the outside of the image forming apparatus 1 while the top cover closed state is maintained.

Figure 27:
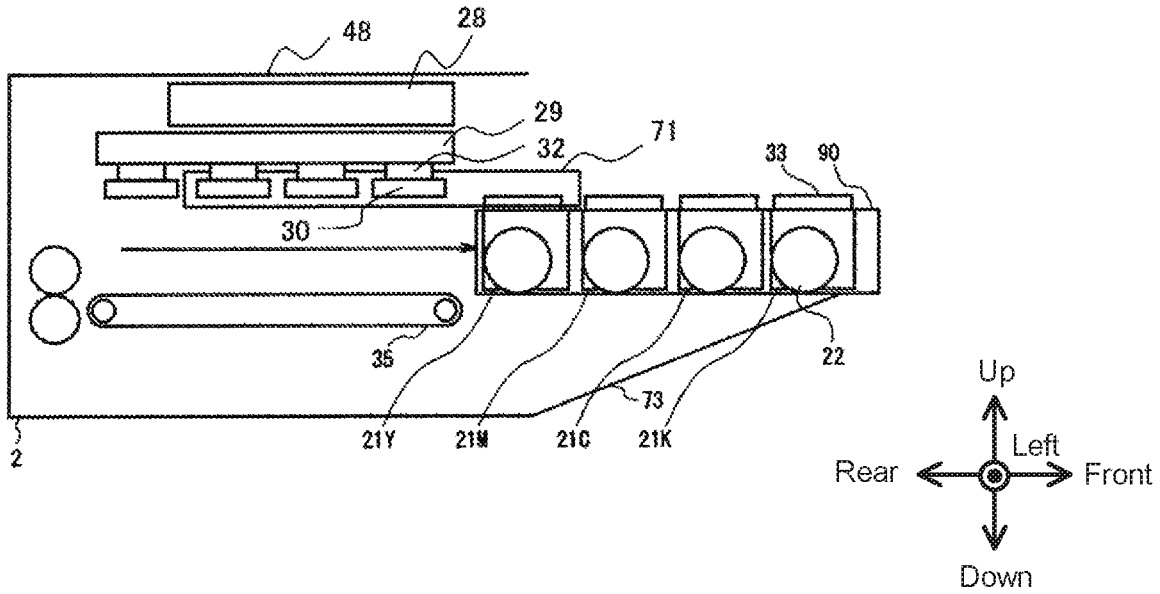
FIG. 27 is a left side view illustrating a simplified configuration of the image forming apparatus in a top cover closed state, in which a basket is in a stored state.

Further, in the above-described embodiment, the case is described in which the present invention is applied to the image forming apparatus 1 of a tandem system having the process units 21 of the respective colors arranged in series along the front-rear direction. Embodiments of the present invention are not limited to this, and may also be applied to LED heads mounted on color printers of various other systems such as a 4-cycle system. Such an alternative is shown in FIG. 27.

Further, in the above-described embodiment, the case is described in which the present invention is applied to the image forming apparatus 1. Embodiments of the present invention are not limited to this, and may also be applied to apparatuses such as a facsimile machine, an MFP (Multi Function Printer), and a copying machine.

Further, embodiments of the present invention are not limited to the above-described embodiments and other embodiments. That is, the application scope of the present invention also covers embodiments obtained by arbitrarily combining some or all of the above-described embodiments and the above-described other embodiments, and embodiments obtained by extracting some of the above-described embodiments and other embodiments.

In the above-described embodiment, the case is described in which the image forming apparatus 1 as a main part is configured by the case 2 as a main body device, the process units 21 as a detachable unit, the shutter handle 71 as an operation part, and the discharge lock mechanisms 79 and locking parts 93 as a lock part. Embodiments of the present invention are not limited to this. It is also possible that an image forming apparatus is configured by a main body device, a detachable unit, an operation part, and a lock part of various other configurations.

The present invention can be used, for example, in an electrophotographic printer.

What is claimed is:

1. An image forming apparatus, comprising:
- a main body device;
- a detachable unit that is attached to the main body device to perform an image formation on a medium, and is detachable with respect to the main body device;
- an operation part that allows the detachable unit to be detached from the main body device; and
- a lock part that
  - locks the operation part in a first state at which the detachable unit is not at an image forming state to perform the image formation, and
  - releases the lock of the operation part in a second state at which the detachable unit is at the image forming state.

2. The image forming apparatus according to claim 1, wherein
- the lock part locks the operation part in the first state at which the detachable unit is detachable with respect to the main body device.

3. The image forming apparatus according to claim 2, wherein
- the lock part locks the operation part in the first state at which the detachable unit is not attached to the main body device.

4. The image forming apparatus according to claim 1, further comprising:
- an upper side opening and closing member that opens and closes an upper side with respect to the main body device, wherein the lock part locks the operation part in the first state at which the upper side opening and closing member is in an open state with respect to the main body device.

5. The image forming apparatus according to claim 1, further comprising:

a toner cartridge that contains toner to supply, and a shutter member that blocks a supply of toner, wherein the detachable unit is a development unit, the toner cartridge is arranged to connect with the development unit when the development unit is attached to the main body device such that the toner in the toner cartridge is supplied to the development unit, the shutter member blocks the supply of toner coming from the toner cartridge to the development unit, and the operation part switches with the shutter member between a supply enabled state of the toner and a blocked state in which the supply of the toner is blocked.

6. The image forming apparatus according to claim 5, further comprising:

a duct that has a supply port to supply the toner from the toner cartridge to the development unit, wherein the shutter member reciprocates between an opening position and a closing position, at the opening position, the shutter member opens the supply port to supply the toner at the supply enabled state, and at the closing position, the shutter member closes the supply port to block the supply of the toner at the blocked state.

7. The image forming apparatus according to claim 6, wherein the development unit is further provided with a shutter through which the toner is supplied to the development unit from the toner cartridge, the shutter is linked with the shutter member such that the shutter moves in correspondence with whether the shutter member is at the opening position or the closing position.

8. The image forming apparatus according to claim 5, wherein the lock part is a lock lever that locks the operation part by engaging with an engaging part provided in the operation part in the first state at which the development unit is not attached to the main body device, and releases the lock of the operation part by not engaging with the engaging part when the development unit is attached to the main body device.

9. The image forming apparatus according to claim 8, further comprising:

one or more developer units that are identical to the development unit, each of the development units containing a toner of different color from others, wherein one or more lock levers that are identical to the lock lever, wherein the lock levers are each provided with the development units.

10. The image forming apparatus according to claim 8, wherein the operation part switches an engagement between the development unit and the toner cartridge.

11. The image forming apparatus according to claim 10, further comprising:

a front side opening and closing member that opens and closes a front side with respect to the main body device, wherein the operation part releases the engagement between the development unit and the toner cartridge by being pulled to a front side, in the first state at which the operation part is pulled out to the front side and the development unit is not attached to the main body device, the lock lever engages with the engaging part provided with the operation part to lock the operation part so that the operation part does not move toward a rear side, and when the operation part is locked so as not to move to the rear side, the front side opening and closing member comes into contact with the operation part before closing the front side of the main body device, and a movement thereof is restricted.

12. The image forming apparatus according to claim 1, further comprising:

an upper side opening and closing member that opens and closes an upper side with respect to the main body device, wherein the operation part switches an engagement between the detachable unit and the upper side opening and closing member.

13. The image forming apparatus according to claim 12, wherein in the first state at which the detachable unit and the upper side opening and closing member are engaged with each other and the upper side opening and closing member is opened with respect to the main body device, the lock part locks the operation part.

14. The image forming apparatus according to claim 13, wherein the operation part is provided in the upper side opening and closing member, the upper side opening and closing member rotates about a shaft provided at a rear end side thereof, and the locking part is a basket locking part that is formed at a front end side of a basket as the detachable unit in which the development unit is accommodated, and locks the operation part that is lifted from the main body device together with the upper side opening and closing member.

* * * * *